US007267935B1

(12) United States Patent
Simpson et al.

(10) Patent No.: US 7,267,935 B1
(45) Date of Patent: Sep. 11, 2007

(54) THERMALLY DEVELOPABLE MATERIALS STABILIZED WITH CROWN ETHERS

(75) Inventors: Sharon M. Simpson, Lake Elmo, MN (US); Kumars Sakizadeh, Woodbury, MN (US)

(73) Assignee: Carestream Health, Inc., Rochester, NY (US)

( * ) Notice: Subject to any disclaimer, the term of this patent is extended or adjusted under 35 U.S.C. 154(b) by 0 days.

(21) Appl. No.: 11/455,415

(22) Filed: Jun. 19, 2006

(51) Int. Cl.
*G03C 5/16* (2006.01)
*G03C 1/498* (2006.01)

(52) U.S. Cl. ..... 430/350; 430/530; 430/600; 430/607; 430/613; 430/614; 430/615; 430/619

(58) Field of Classification Search ..... 430/619, 430/350, 530, 607, 613, 614, 615, 600
See application file for complete search history.

(56) References Cited

U.S. PATENT DOCUMENTS

| | | | |
|---|---|---|---|
| 5,395,747 A | 3/1995 | Helland et al. | |
| 5,545,515 A | 8/1996 | Murray et al. | |
| 5,654,130 A | 8/1997 | Murray | |
| 6,100,022 A | 8/2000 | Inoue et al. | |
| 6,329,135 B1 | 12/2001 | Kashiwagi | |
| 6,387,605 B1 | 5/2002 | Lynch et al. | |
| 6,475,710 B2 | 11/2002 | Kudo et al. | |
| 6,746,835 B2 * | 6/2004 | Watanabe et al. | 430/619 |
| 2004/0018458 A1 | 1/2004 | Nakagawa | |
| 2004/0023174 A1 | 2/2004 | Ohzeki et al. | |
| 2005/0158675 A9 | 7/2005 | Ohzeki et al. | |

FOREIGN PATENT DOCUMENTS

| | | |
|---|---|---|
| JP | 2001-013617 | 1/2001 |
| JP | 2003-114495 | 4/2003 |
| JP | 2004-101688 | 4/2004 |
| JP | 2004-272062 | 9/2004 |

* cited by examiner

*Primary Examiner*—Thorl Chea

(57) ABSTRACT

Incorporating a crown ether-alkali metal complex cation of an enolate anion of an aldehyde having at least one electron withdrawing group in the alpha ($\alpha$) position, provides thermally developable materials with imaging properties that have little change with changes in humidity. Both photothermographic and thermographic materials are provided, and particularly photothermographic materials having lower silver coverage.

21 Claims, No Drawings

THERMALLY DEVELOPABLE MATERIALS STABILIZED WITH CROWN ETHERS

FIELD OF THE INVENTION

This invention relates to thermally developable materials having little variation in imaging properties with changes in humidity. This invention also relates to methods of imaging and using these materials.

BACKGROUND OF THE INVENTION

Silver-containing direct thermographic and photothermographic imaging materials (that is, thermally developable imaging materials) that are imaged and/or developed using heat and without liquid processing have been known in the art for many years.

Silver-containing direct thermographic imaging materials are non-photosensitive materials that are used in a recording process wherein images are generated by the direct application of thermal energy and in the absence of a processing solvent. These materials generally comprise a support having disposed thereon (a) a relatively or completely non-photosensitive source of reducible silver ions, (b) a reducing composition (acting as a black-and-white silver developer) for the reducible silver ions, and (c) a suitable binder. Thermographic materials are sometimes called "direct thermal" materials in the art because they are directly imaged by a source of thermal energy without any transfer of the image or image-forming materials to another element (such as in thermal dye transfer).

In a typical thermographic construction, the image-forming thermographic layers comprise non-photosensitive reducible silver salts of long chain fatty acids. A preferred non-photosensitive reducible silver source is a silver salt of a long chain aliphatic carboxylic acid having from 10 to 30 carbon atoms, such as behenic acid or mixtures of acids of similar molecular weight. At elevated temperatures, the silver of the silver carboxylate is reduced by a reducing agent for silver ion (also known as a developer), whereby elemental silver is formed. Preferred reducing agents include methyl gallate, hydroquinone, substituted-hydroquinones, hindered phenols, catechols, pyrogallol, ascorbic acid, and ascorbic acid derivatives.

Some thermographic constructions are imaged by contacting them with the thermal head of a thermographic recording apparatus such as a thermal print-head of a thermal printer or thermal facsimile. In such constructions, an anti-stick layer is coated on top of the imaging layer to prevent sticking of the thermographic construction to the thermal head of the apparatus utilized. The resulting thermographic construction is then heated imagewise to an elevated temperature, typically in the range of from about 60 to about 225° C., resulting in the formation of a black-and-white image of silver.

Silver-containing photothermographic imaging materials (that is, photosensitive thermally developable imaging materials) that are imaged with actinic radiation and then developed using heat and without liquid processing, have also been known in the art for many years. Such materials are used in a recording process wherein an image is formed by imagewise exposure of the photothermographic material to specific electromagnetic radiation (for example, X-radiation, or ultraviolet, visible, or infrared radiation) and developed by the use of thermal energy. These materials, also known as "dry silver" materials, generally comprise a support having coated thereon: (a) a photocatalyst (that is, a photosensitive compound such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (usually including a developer) for the reducible silver ions, and (d) a binder. The latent image is then developed by application of thermal energy.

In photothermographic materials, exposure of the photosensitive silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image of silver while much of the silver halide, generally, remains as silver halide and is not reduced.

In photothermographic materials, the reducing agent for the reducible silver ions, often referred to as a "developer", may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. Upon heating, and at elevated temperatures, the reducible silver ions are reduced by the reducing agent. This reaction occurs preferentially in the regions surrounding the latent image and produces a negative image of metallic silver having a color that ranges from yellow to deep black depending upon the presence of toning agents and other components in the photothermographic imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

In photothermographic imaging materials, a visible image is created in the absence of a processing solvent by heat as a result of the reaction of a reducing agent incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example, a silver carboxylate or a silver benzotriazole) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself at least partially converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. The incorporation of the reducing agent into photothermographic materials can lead to increased formation of various types of "fog" or other undesirable sensitometric side effects. Therefore, much effort has gone into the preparation and manufacture of photothermographic materials to minimize these problems.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Unconventional Imaging Processes*, E. Brinckman et al. (Eds.), The Focal Press, London and New York, 1978, pp. 74-75, in D. H. Klosterboer, *Imaging Processes and Materials*, (Neblette's Eighth Edition), J. Sturge, V. Walworth, and A. Shepp, Eds., Van Nostrand-Reinhold, New York, 1989, Chapter 9, pp. 279-291, in Zou et al., *J. Imaging Sci. Technol.* 1996,40, pp. 94-103, and in M. R. V. Sahyun, *J. Imaging Sci. Technol.* 1998, 42, 23.

Problem to be Solved

One problem encountered in the use of thermally developable materials is that only a fraction of the thermally developable silver salt is developed in a given area for a given exposure. Thus, high silver coating weights are needed to assure good image densities upon thermal development. However silver salts are expensive and this increases manufacturing costs. One approach to increasing the amount of silver developed while using less silver salt, is to lower the coating weight of the developable silver salt and at the same time add a co-developer to increase contrast. While this approach lowers the amount of silver needed, it often results in high-contrast images and a loss of grey scale.

Another problem encountered in the use of thermally developable materials is the variation of their sensitometric properties such as the maximum density achieved with a given exposure ($D_{max}$) with changes in humidity during storage and before imaging and development. This problem is often overcome by increasing the coating weight of the thermally developable silver salt. This increases the developed $D_{max}$, as variations in image density at high densities are less noticeable. However, this increases the cost of silver in the material and is at odds with the desire to decrease manufacturing costs by lowering the amount of silver salt.

U.S. Pat. Nos. 5,545,515, (Murray et al.), 5,654,130 (Murray), 6,100,022 (Inoue et al.), and 6,387,605 (Lynch et al.) describe various co-developers useful in photothermographic materials having an enolate of an aldehyde having a carbonyl group in the beta (β) position, and an electron withdrawing group in the alpha (α) position. While these materials are effective in reducing the amount of thermally developable silver required there is a need for further improvements to solve the problems associated with changes in $D_{max}$ with changes in humidity.

Crown ethers are notable for their ability to strongly solvate cations. The result is that the complexed cation is soluble in nonpolar solvents. The reactivity of the resultant anion is increased, permitting reactions to take place in nonpolar solvents that would not otherwise occur.

U.S. Pat. No. 6,265,146 (Kashiwagi) describes the incorporation of heteroatom containing macrocyclic compounds such as crown ethers into photothermographic materials. U.S. Pat. No. 6,329,135 (Kashiwagi) describes silver halide photothermographic materials having a light-sensitive layer comprising a sensitizing dye and a light-insensitive layer wherein either layer comprises a heteroatom containing macrocyclic compound such as a crown ether.

Japan Kokai 2004-272062 (Konica) describes thermally developable photosensitive materials containing an organic silver particle, a silver halide, a reducing agent, a nucleating agent, and a cyclic polyamine or polythioether compound on a support.

U.S. Patent Application Publication 2005/0147931 (Yamamoto et al.) discloses the use of crown ethers and propenenitrile compounds in the preparation of photothermographic materials.

In all of the above references crown ether compounds are added to photothermographic formulation as separate compounds and not as a part of a complex.

Despite the considerable research and knowledge in the art relating to various developers and co-developers in thermally developable materials, there remains a need for additional effective co-developers that provide more efficient use of silver, allow a reduction in the amount of silver, and show little dependence in sensitometric properties with humidity, without changes in other sensitometric properties such as $D_{max}$, grey scale, and photospeed.

SUMMARY OF THE INVENTION

To address this need, this invention provides a thermally developable material comprising a support having on at least one side thereof, one or more thermally developable imaging layers comprising in reactive association:

a. a non-photosensitive source of reducible silver ions, b. a reducing agent for the reducible silver ions, c. a polymeric binder, and d a co-developer compound that is a crown ether-alkali metal complex cation and an enolate anion of an aldehyde having at least one electron withdrawing group in the alpha (α) position.

This invention also provides a photothermographic material comprising a support having on at least one side thereof, one or more thermally developable imaging layers comprising in reactive association:

a. a photosensitive silver halide, b. a non-photosensitive source of reducible silver ions, c. a reducing agent for the reducible silver ions, d. a polymeric binder, and e. a co-developer compound that is a crown ether-alkali metal complex cation and an enolate anion of an aldehyde having at least one electron withdrawing groups in the alpha ($\alpha$) position, having a Hammett $\sigma_p$ value that is at least 0.35.

In preferred embodiments, the black-and-white, organic solvent based photothermographic material of this invention comprises a support and having on at least one side thereof a photothermographic layer and comprising, in reactive association:

a. a photosensitive silver bromide or iodobromide, b. a non-photosensitive source of reducible silver ions, comprising at least silver behenate, c. one or more reducing agents for the reducible silver ions, d. a polyvinyl butyral or polyvinyl acetal binder, and e. one or more co-developer compounds represented by Structure (I)

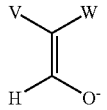

(I)

[CROWN ETHER - $M^+$]

wherein CROWN ETHER is a substituted or unsubstituted 18-crown-6, $M^+$ is a potassium cation, W is a carboxyalkyl group having 1 to 20 carbon atoms and V is a cyano group, the total amount of silver is present in an amount equal to or less than 1.6 g/m$^2$, and the co-developer compound is present in an amount of at least 0.0005 g/m$^2$.

This invention further provides a method of forming a visible image comprising:

(A) imagewise exposing a thermally developable material of this invention that is a photothermographic material to electromagnetic radiation to form a latent image, (B) simultaneously or sequentially, heating the exposed photothermographic material to develop the latent image into a visible image.

In alternative methods of this invention, a method of forming a visible image comprises:

(A') thermal imaging of the thermally developable material of this invention that is a thermographic material.

We have found that incorporating a crown ether-alkali metal complex cation and an enolate anion of an aldehyde having at least one electron withdrawing group in the alpha ($\alpha$) position, provides photothermographic and thermographic materials in which one or more imaging properties such as $D_{max}$ and Silver Efficiency are little changed with changes in humidity. These advantages are particularly evident when the coating level of silver is reduced from those normally used in photothermographic materials.

DETAILED DESCRIPTION OF THE INVENTION

The thermally developable materials described herein are both thermographic and photothermographic materials. While the following discussion will often be directed primarily to the preferred photothermographic embodiments, it would be readily understood by one skilled in the art that thermographic materials can be similarly constructed and used to provide black-and-white or color images using appropriate imaging chemistry and particularly non-photosensitive organic silver salts, reducing agents, toners, binders, and other components known to a skilled artisan. In both thermographic and photothermographic materials, the co-developer materials described herein are in reactive association with the non-photosensitive silver salt and the reducing agent.

The thermally developable materials described herein can be used in black-and-white or color thermography or photothermography and in electronically generated black-and-white or color hardcopy recording. They can be used in microfilm applications, in radiographic imaging (for example digital medical imaging), X-ray radiography, and in industrial radiography. Furthermore, the absorbance of these photothermographic materials between 350 and 450 nm is desirably low (less than 0.5), to permit their use in the graphic arts area (for example, image-setting and phototypesetting), in the manufacture of printing plates, in contact printing, in duplicating ("duping"), and in proofing.

The thermally developable materials are particularly useful for imaging of human or animal subjects in response to, X-radiation, ultraviolet, visible, or infrared radiation for use in a medical diagnosis. Such applications include, but are not limited to, thoracic imaging, mammography, dental imaging, orthopedic imaging, general medical radiography, therapeutic radiography, veterinary radiography, and autoradiography. When used with X-radiation, the photothermographic materials may be used in combination with one or more phosphor intensifying screens, with phosphors incorporated within the photothermographic emulsion, or with combinations thereof. Such materials are particularly useful for dental radiography when they are directly imaged by X-radiation. The materials are also useful for non-medical uses of X-radiation such as X-ray lithography and industrial radiography.

The photothermographic materials can be made sensitive to radiation of any suitable wavelength. Thus, in some embodiments, the materials are sensitive at ultraviolet, visible, infrared, or near infrared wavelengths, of the electromagnetic spectrum. In preferred embodiments, the materials are sensitive to radiation greater than 600 nm (and preferably sensitive to infrared radiation from about 700 up to about 950 nm). Increased sensitivity to a particular region of the spectrum is imparted through the use of various spectral sensitizing dyes.

In the photothermographic materials, the components needed for imaging can be in one or more photothermographic imaging layers on one side ("frontside") of the support. The layer(s) that contain the photosensitive photocatalyst (such as a photosensitive silver halide) or non-photosensitive source of reducible silver ions, or both, are referred to herein as photothermographic emulsion layer(s). The photocatalyst and the non-photosensitive source of reducible silver ions are in catalytic proximity and preferably are in the same emulsion layer.

Similarly, in the thermographic materials, the components needed for imaging can be in one or more layers. The layer(s) that contain the non-photosensitive source of reducible silver ions are referred to herein as thermographic emulsion layer(s).

Where the photothermographic materials contain imaging layers on one side of the support only, various non-imaging layers are usually disposed on the "backside" (non-emulsion or non-imaging side) of the materials, including conductive/antistatic layers, antihalation layers, protective layers, and transport enabling layers.

Various non-imaging layers can also be disposed on the "frontside" or imaging or emulsion side of the support, including protective frontside overcoat layers, primer layers, interlayers, opacifying layers, conductive/antistatic layers, antihalation layers, acutance layers, auxiliary layers, and other layers readily apparent to one skilled in the art.

For some embodiments, it may be useful that the photothermographic materials be "double-sided" or "duplitized" and have the same or different photothermographic coatings (or imaging layers) on both sides of the support. In such constructions each side can also include one or more protective overcoat layers, primer layers, interlayers, acutance layers, conductive/antistatic layers auxiliary layers, anti-crossover layers, and other layers readily apparent to one skilled in the art, as well as the required conductive layer(s).

When the thermally developable materials are heat-developed as described below in a substantially water-free condition after, or simultaneously with, imagewise exposure, a silver image (preferably a black-and-white silver image) is obtained.

Definitions

As used herein:

In the descriptions of the photothermographic materials, "a" or "an" component refers to "at least one" of that component (for example, the co-developer compounds containing a crown ether alkali-metal complex of an enolate anion of an aldehyde having at least one electron withdrawing group in the alpha (a) position described herein).

As used herein, "black-and-white" preferably refers to an image formed by silver metal.

Unless otherwise indicated, when the terms "thermally developable materials", "photothermographic materials", and "thermographic materials" are used herein, the terms refer to materials of the present invention.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water or any other solvent for inducing or promoting the reaction is not particularly or positively supplied from the exterior to the material. Such a condition is described in T. H. James, *The Theory of the Photographic Process*, Fourth Edition, Eastman Kodak Company, Rochester, N.Y., 1977, p. 374.

"Photothermographic material(s)" means a dry processable integral element comprising a support and at least one photothermographic emulsion layer or a photothermographic set of emulsion layers (wherein the photosensitive silver halide and the source of reducible silver ions are in one layer and the other necessary components or additives are distributed, as desired, in the same layer or in an adjacent coated layer). In the case of black-and-white thermally developable materials, a black-and-white silver image is produced. These materials also include multilayer constructions in which one or more imaging components are in different layers, but are in "reactive association". For example, one layer can include the non-photosensitive source of reducible silver ions and another layer can include the reducing composition, but the two reactive components are in reactive association with each other. By "integral", we mean that all imaging chemistry required for imaging is in the material without diffusion of imaging chemistry or reaction products (such as a dye) from or to another element (such as a receiver element).

"Thermographic materials" are similarly defined except that no photosensitive silver halide catalyst is purposely added or created.

When used in photothermography, the term, "imagewise exposing" or "imagewise exposure" means that the material is imaged as a dry processable material using any exposure means that provides a latent image using electromagnetic radiation. This includes, for example, by analog exposure where an image is formed by projection onto the photosensitive material as well as by digital exposure where the image is formed one pixel at a time such as by modulation of scanning laser radiation.

When used in thermography, the term, "imagewise exposing" or "imagewise exposure" means that the material is imaged as a dry processable material using any means that provides an image using heat. This includes, for example, by analog exposure where an image is formed by differential contact heating through a mask using a thermal blanket or infrared heat source, as well as by digital exposure where the image is formed one pixel at a time such as by modulation of thermal print-heads or by thermal heating using scanning laser radiation.

The term "emulsion layer", "imaging layer", "thermographic emulsion layer", or "photothermographic emulsion layer" means a layer of a thermographic or photothermographic material that contains the photosensitive silver halide (when used) and/or non-photosensitive source of reducible silver ions, or a reducing composition. Such layers can also contain additional components or desirable additives. These layers are on what is referred to as the "frontside" of the support.

"Photocatalyst" means a photosensitive compound such as silver halide that, upon exposure to radiation, provides a compound that is capable of acting as a catalyst for the subsequent development of the image-forming material.

"Catalytic proximity" or "reactive association" means that the reactive components are in the same layer or in adjacent layers so that they readily come into contact with each other during imaging and thermal development.

"Simultaneous coating" or "wet-on-wet" coating means that when multiple layers are coated, subsequent layers are coated onto the initially coated layer before the initially coated layer is dry. Simultaneous coating can be used to apply layers on the frontside, backside, or both sides of the support.

"Transparent" means capable of transmitting visible light or imaging radiation without appreciable scattering or absorption.

The phrases "silver salt" and "organic silver salt" refer to an organic molecule having a bond to a silver atom. Although the compounds so formed are technically silver coordination complexes or silver compounds they are also often referred to as silver salts.

The phrase "aryl group" refers to an organic group derived from an aromatic hydrocarbon by removal of one atom, such as a phenyl group formed by removal of one hydrogen atom from benzene.

The term "co-developer" refers to an organic compound that by itself does not act as an effective reducing agent for the non-photosensitive silver salt, but when used in combination with a reducing agent and a non-photosensitive silver salt provides, upon development, increased silver development. This results in increased optical density ($D_{max}$) and improved Silver Efficiency.

"Silver Efficiency" is defined as $D_{max}$ divided by the total silver coating weight. It is a measure of the amount of silver that has developed under a given set of exposure and development conditions.

The term "buried layer" means that there is at least one other layer disposed over the layer (such as a "buried" backside conductive layer).

The terms "coating weight", "coat weight", and "coverage" are synonymous, and are usually expressed in weight or moles per unit area such as $g/m^2$ or $mol/m^2$.

"Ultraviolet region of the spectrum" refers to that region of the spectrum less than or equal to 400 nm (preferably from about 100 nm to about 400 nm) although parts of these ranges may be visible to the naked human eye.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

The sensitometric terms "photospeed", "speed", or "photographic speed" (also known as sensitivity), absorbance, and contrast have conventional definitions known in the imaging arts. The sensitometric term absorbance is another term for optical density (OD).

Speed-2 is Log1/E+4 corresponding to the density value of 1.0 above $D_{min}$ where E is the exposure in $ergs/cm^2$.

In photothermographic materials, the term $D_{min}$ (lower case) is considered herein as image density achieved when the photothermographic material is thermally developed without prior exposure to radiation. The term $D_{max}$ (lower case) is the maximum image density achieved in the imaged area of a particular sample after imaging and development.

The term $D_{MIN}$ (upper case) is the density of the nonimaged, undeveloped material. The term $D_{MAX}$ (upper case) is the maximum image density achievable when the photothermographic material is exposed and then thermally developed. $D_{MAX}$ is also known as "Saturation Density".

As is well understood in this art, for the chemical compounds herein described, substitution is not only tolerated, but is often advisable and various substituents are anticipated on the compounds used in the present invention unless otherwise stated. Thus, when a compound is referred to as "having the structure" of a given formula or being a "derivative" of a compound, any substitution that does not alter the bond structure of the formula or the shown atoms within that structure is included within the formula, unless such substitution is specifically excluded by language.

As a means of simplifying the discussion and recitation of certain substituent groups, the term "group" refers to chemical species that may be substituted as well as those that are not so substituted. Thus, the term "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example $CH_3—CH_2-CH_2—O—CH_2—$ and $CH_3—CH_2-CH_2—S—CH_2—$), haloalkyl, nitroalkyl, alkylcarboxy, carboxyalkyl, carboxamido, hydroxyalkyl, sulfoalkyl, and other groups readily apparent to one skilled in the art. Substituents that adversely react with other active ingredients, such as very strongly electrophilic or oxidizing substituents, would, of course, be excluded by the skilled artisan as not being inert or harmless.

Research Disclosure (http://www.researchdisclosure.com) is a publication of Kenneth Mason Publications Ltd., The Book Barn, Westbourne, Hampshire PO1O 8RS, UK. It is also available from Emsworth Design Inc., 200 Park Avenue South, Room 1101, New York, N.Y. 10003.

Other aspects, advantages, and benefits of the present invention are apparent from the detailed description, examples, and claims provided in this application.

The Photocatalyst

As noted above, photothermographic materials include one or more photocatalysts in the photothermographic emulsion layer(s). Useful photocatalysts are typically photosensitive silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide and silver iodide are preferred. More preferred is silver bromoiodide in which any suitable amount of iodide is present up to almost 100% silver iodide and more likely up to about 40 mol % silver iodide. Even more preferably, the silver bromoiodide comprises at least 70 mole % (preferably at least 85 mole % and more preferably at least 90 mole %) bromide (based on total silver halide). The remainder of the halide is iodide, chloride, or chloride and iodide. Preferably the additional halide is iodide. Silver bromide and silver bromoiodide are most preferred, with the latter silver halide generally having up to 10 mole % silver iodide.

In some embodiments of aqueous-based photothermographic materials, higher amounts of iodide may be present in homogeneous photosensitive silver halide grains, and particularly from about 20 mol % up to the saturation limit of iodide as described, for example, U.S. Patent Application Publication 2004/0053173 (Maskasky et al.).

The silver halide grains may have any crystalline habit or morphology including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of grains with different morphologies can be employed. Silver halide grains having cubic and tabular morphology (or both) are preferred.

The silver halide grains may have a uniform ratio of halide throughout. They may also have a graded halide content, with a continuously varying ratio of, for example, silver bromide and silver iodide or they may be of the core-shell type, having a discrete core of one or more silver halides, and a discrete shell of one or more different silver halides. Core-shell silver halide grains useful in photothermographic materials and methods of preparing these materials are described in U.S. Pat. No. 5,382,504 (Shor et al.), incorporated herein by reference. Iridium and/or copper doped core-shell and non-core-shell grains are described in U.S. Pat. Nos. 5,434,043 (Zou et al.) and 5,939,249 (Zou). Bismuth(III)-doped high silver iodide emulsions for aqueous-based photothermographic materials are described in U.S. Pat. No. 6,942,960 (Maskasky et al.). All of the above patents are incorporated herein by reference.

In some instances, it may be helpful to prepare the photosensitive silver halide grains in the presence of a hydroxytetraazaindene (such as 4-hydroxy-6-methyl-1,3,3a,7-tetraazaindene) or an N-heterocyclic compound comprising at least one mercapto group (such as 1-phenyl-5-mercaptotetrazole) as described in U.S. Pat. No. 6,413,710 (Shor et al.) that is incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. With this technique, one has the possibility of more precisely controlling the grain size, grain size distribution, dopant levels, and composition of the silver halide, so that one can impart more specific properties to both the silver halide grains and the resulting photothermographic material.

In some constructions, it is preferable to form the non-photosensitive source of reducible silver ions in the presence of ex-situ-prepared silver halide. In this process, the source of reducible silver ions, such as a long chain fatty acid silver carboxylate (commonly referred to as a silver "soap" or homogenate), is formed in the presence of the preformed silver halide grains. Co-precipitation of the source of reducible silver ions in the presence of silver halide provides a more intimate mixture of the two materials to provide a material often referred to as a "preformed soap" [see U.S. Pat. No. 3,839,049 (Simons)].

In some constructions, it is preferred that preformed silver halide grains be added to and "physically mixed" with the non-photosensitive source of reducible silver ions.

Preformed silver halide emulsions can be prepared by aqueous or organic processes and can be unwashed or washed to remove soluble salts. Soluble salts can be removed by any desired procedure for example as described in U.S. Pat. Nos. 2,489,341 (Waller et al.), 2,565,418 (Yackel), 2,614,928 (Yutzy et al.), 2,618,556 (Hewitson et al.), and 3,241,969 (Hart et al.).

It is also effective to use an in-situ process in which a halide- or a halogen-containing compound is added to an organic silver salt to partially convert the silver of the organic silver salt to silver halide. Inorganic halides (such as zinc bromide, zinc iodide, calcium bromide, lithium bromide, lithium iodide, or mixtures thereof) or an organic halogen-containing compound (such as N-bromo-succinimide or pyridinium hydrobromide perbromide) can be used. The details of such in-situ generation of silver halide are well known and described in U.S. Pat. No. 3,457,075 (Morgan et al.).

It is particularly effective to use a mixture of both preformed and in-situ generated silver halide. The preformed silver halide is preferably present in a preformed soap.

Additional methods of preparing silver halides and organic silver salts and blending them are described in Research Disclosure, June 1978, item 17029, U.S. Pat. Nos. 3,700,458 (Lindholm) and 4,076,539 (Ikenoue et al.), and Japan Kokai 49-013224 (Fuji), 50-017216 (Fuji), and 51-042529 (Fuji).

The silver halide grains used in the imaging formulations can vary in average diameter of up to several micrometers (μm) depending on the desired use. Preferred silver halide grains for use in preformed emulsions containing silver carboxylates are cubic grains having a number average particle size of from about 0.01 to about 1.0 μm, more preferred are those having a number average particle size of from about 0.03 to about 0.1 μm. It is even more preferred that the grains have a number average particle size of 0.06 μm or less, and most preferred that they have a number average particle size of from about 0.03 to about 0.06 μm. Mixtures of grains of various average particle size can also be used. Preferred silver halide grains for high-speed photothermographic constructions use are tabular grains having an average thickness of at least 0.02 μm and up to and including 0.10 μm, an equivalent circular diameter of at least 0.5 μm and up to and including 8 μm and an aspect ratio of at least 5:1. More preferred are those having an average thickness of at least 0.03 μm and up to and including 0.08 μm, an equivalent circular diameter of at least 0.75 μm and up to and including 6 μm and an aspect ratio of at least 10:1.

The average size of the photosensitive silver halide grains is expressed by the average diameter if the grains are spherical, and by the average of the diameters of equivalent circles for the projected images if the grains are cubic or in other non-spherical shapes. Representative grain sizing methods are described in *Particle Size Analysis*, ASTM Symposium on Light. Microscopy, R. P. Loveland, 1955, pp. 94-122, and in C. E. K. Mees and T. H. James, *The Theory of the Photographic Process*, Third Edition, Macmillan, New York, 1966, Chapter 2. Particle size measurements may be expressed in terms of the projected areas of grains or approximations of their diameters. These will provide reasonably accurate results if the grains of interest are substantially uniform in shape.

The one or more light-sensitive silver halides are preferably present in an amount of from about 0.005 to about 0.5 mole, more preferably from about 0.01 to about 0.25 mole, and most preferably from about 0.03 to about 0.15 mole, per mole of non-photosensitive source of reducible silver ions.

Chemical Sensitization

The photosensitive silver halides can be chemically sensitized using any useful compound that contains sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Eastman Kodak Company, Rochester, N.Y., 1977, Chapter 5, pp. 149-169. Suitable conventional chemical sensitization procedures are also described in U.S. Pat. Nos. 1,623,499 (Sheppard et al.), 2,399,083 (Waller et al.), 3,297,446 (Dunn), 3,297,447 (McVeigh), 5,049,485 (Deaton), 5,252,455 (Deaton), 5,391,727 (Deaton), 5,759,761 (Lushington et al.), and 5,912,111 (Lok et al.), and EP 0 915 371A1 (Lok et al.), all of which are incorporated herein by reference.

Mercaptotetrazoles and tetraazindenes as described in U.S. Pat. No. 5,691,127 (Daubendiek et al.), incorporated herein by reference, can also be used as suitable addenda for tabular silver halide grains.

Certain substituted and unsubstituted thiourea compounds can be used as chemical sensitizers including those described in U.S. Pat. No. 6,368,779 (Lynch et al.) that is incorporated herein by reference.

Still other additional chemical sensitizers include certain tellurium-containing compounds that are described in U.S. Pat. No. 6,699,647 (Lynch et al.), and certain selenium-containing compounds that are described in U.S. Pat. No. 6,620,577 (Lynch et al.), that are both incorporated herein by reference.

Combinations of gold(III)-containing compounds and either sulfur-, tellurium-, or selenium-containing compounds are also useful as chemical sensitizers as described in U.S. Pat. No. 6,423,481 (Simpson et al.) that is also incorporated herein by reference.

In addition, sulfur-containing compounds can be decomposed on silver halide grains in an oxidizing environment according to the teaching in U.S. Pat. No. 5,891,615 (Winslow et al.). Examples of sulfur-containing compounds that can be used in this fashion include sulfur-containing spectral sensitizing dyes. Other useful sulfur-containing chemical sensitizing compounds that can be decomposed in an oxidizing environment are the diphenylphosphine sulfide compounds described in U.S. Pat. No. 7,026,105 (Simpson et al.) and in copending and commonly assigned U.S. Patent Application Publications 2005/0123871 (Burleva et al.), and 2005/0123872 (Burleva et al.). The above patents and patent application publications are incorporated herein by reference.

The chemical sensitizers can be present in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver for silver halide grains having an average size of from about 0.01 to about 1 μm.

Spectral Sensitization

The photosensitive silver halides may be spectrally sensitized with one or more spectral sensitizing dyes that are known to enhance silver halide sensitivity to ultraviolet, visible, and/or infrared radiation (that is, sensitivity within the range of from about 300 to about 1400 nm). It is preferred that the photosensitive silver halide be sensitized to infrared radiation (that is from about 700 to about 950 nm). Non-limiting examples of spectral sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. They may be added at any stage in the preparation of the photothermographic emulsion, but are generally added after chemical sensitization is achieved.

Suitable spectral sensitizing dyes such as those described in U.S. Pat. Nos. 3,719,495 (Lea), 4,396,712 (Kinoshita et al.), 4,439,520 (Kofron et al.), 4,690,883 (Kubodera et al.), 4,840,882 (Iwagaki et al.), 5,064,753 (Kohno et al.), 5,281,515 (Delprato et al.), 5,393,654 (Burrows et al.), 5,441,866 (Miller et al.), 5,508,162 (Dankosh), 5,510,236 (Dankosh), and 5,541,054 (Miller et al.), Japan Kokai 2000-063690 (Tanaka et al.), 2000-112054 (Fukusaka et al.), 2000-273329 (Tanaka et al.), 2001-005145 (Arai), 2001-064527 (Oshiyama et al.), and 2001-154305 (Kita et al.) can be used. Useful spectral sensitizing dyes are also described in Research Disclosure, December 1989, item 308119, Section IV and Research Disclosure, 1994, item 36544, section V. All of the publications noted above are incorporated herein by reference.

Teachings relating to specific combinations of spectral sensitizing dyes also include U.S. Pat. Nos. 4,581,329 (Sugimoto et al.), 4,582,786 (Ikeda et al.), 4,609,621 (Sugimoto et al.), 4,675,279 (Shuto et al.), 4,678,741 (Yamada et al.), 4,720,451 (Shuto et al.), 4,818,675 (Miyasaka et al.), 4,945,036 (Arai et al.), and 4,952,491 (Nishikawa et al.). All of the above publications and patents are incorporated herein by reference.

Also useful are spectral sensitizing dyes that decolorize by the action of light or heat as described in U.S. Pat. No. 4,524,128 (Edwards et al.) and Japan Kokai 2001-109101 (Adachi), 2001-154305 (Kita et al.), and 2001-183770 (Hanyu et al.), all incorporated herein by reference.

Dyes and other compounds may be selected for the purpose of supersensitization to attain much higher sensitivity than the sum of sensitivities that can be achieved by using a sensitizer alone. Examples of such supersensitizers include the metal chelating compounds disclosed in U.S. Pat. No. 4,873,184 (Simpson), the large cyclic compounds featuring a heteroatom disclosed in U.S. Pat. No. 6,475,710 (Kudo et al.), the stilbene compounds disclosed in EP 0 821 271 (Uytterhoeven et al.).

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions in the thermally developable materials is a silver-organic compound that contains reducible silver(I) ions. Such compounds are generally silver salts of silver organic coordinating ligands that are comparatively stable to light and form a silver image when heated to 50° C. or higher in the presence of an exposed photocatalyst (such as silver halide, when used in a photothermographic material) and a reducing agent composition.

The primary organic silver salt is often a silver salt of an aliphatic carboxylic acid (described below). Mixtures of silver salts of aliphatic carboxylic acids are particularly useful where the mixture includes at least silver behenate.

Useful silver carboxylates include silver salts of long-chain aliphatic carboxylic acids. The aliphatic carboxylic acids generally have aliphatic chains that contain 10 to 30, and preferably 15 to 28, carbon atoms. Examples of such preferred silver salts include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Most preferably, at least silver behenate is used alone or in mixtures with other silver carboxylates.

Silver salts other than the silver carboxylates described above can be used also. Such silver salts include silver salts of aliphatic carboxylic acids containing a thioether group as described in U.S. Pat. No. 3,330,663 (Weyde et al.), soluble silver carboxylates comprising hydrocarbon chains incorporating ether or thioether linkages or sterically hindered substitution in the α- (on a hydrocarbon group) or ortho- (on an phenyl group) position as described in U.S. Pat. No. 5,491,059 (Whitcomb), silver salts of dicarboxylic acids, silver salts of sulfonates as described in U.S. Pat. No. 4,504,575 (Lee), silver salts of sulfosuccinates as described in EP 0 227 141A1 (Leenders et al.), silver salts of aryl carboxylic acids (such as silver benzoate), silver salts of acetylenes as described, for example in U.S. Pat. Nos. 4,761,361 (Ozaki et al.) and 4,775,613 (Hirai et al.), and silver salts of heterocyclic compounds containing mercapto or thione groups and derivatives as described in U.S. Pat. Nos. 4,123,274 (Knight et al.) and 3,785,830 (Sullivan et al.).

It is also convenient to use silver half soaps such as an equimolar blend of a silver carboxylate and a carboxylic acid that analyzes for about 14.5% by weight solids of silver in the blend and that is prepared by precipitation from an aqueous solution of an ammonium or an alkali metal salt of a commercially available fatty carboxylic acid, or by addition of the free fatty acid to the silver soap.

The methods used for making silver soap emulsions are well known in the art and are disclosed in Research Disclosure, April 1983, item 22812, Research Disclosure, October 1983, item 23419, U.S. Pat. No. 3,985,565 (Gabrielsen et al.) and the references cited above.

Sources of non-photosensitive reducible silver ions can also be core-shell silver salts as described in U.S. Pat. No. 6,355,408 (Whitcomb et al.), wherein a core has one or more silver salts and a shell has one or more different silver salts, as long as one of the silver salts is a silver carboxylate. Other useful sources of non-photosensitive reducible silver ions are the silver dimer compounds that comprise two different silver salts as described in U.S. Pat. No. 6,472,131 (Whitcomb). Still other useful sources of non-photosensitive reducible silver ions are the silver core-shell compounds comprising a primary core comprising one or more photosensitive silver halides, or one or more non-photo-sensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in U.S. Pat. No. 6,803,177 (Bokhonov et al.). All of the above patents are incorporated herein by reference.

Organic silver salts that are particularly useful in organic solvent-based thermographic and photothermographic materials include silver carboxylates (both aliphatic and aryl carboxylates), silver benzotriazolates, silver sulfonates, silver sulfosuccinates, and silver acetylides. Silver salts of long-chain aliphatic carboxylic acids containing 15 to 28 carbon atoms and silver salts of benzotriazoles are particularly preferred. Silver carboxylates containing silver behenate are most preferred.

Organic silver salts that are particularly useful in aqueous based thermographic and photothermographic materials include silver salts of compounds containing an imino group. Preferred examples of these compounds include, but are not limited to, silver salts of benzotriazole and substituted derivatives thereof (for example, silver methylbenzotriazole and silver 5-chloro-benzotriazole), silver salts of 1,2,4-triazoles or 1-H-tetrazoles such as phenyl-mercaptotetrazole as described in U.S. Pat. No. 4,220,709 (deMauriac), and silver salts of imidazoles and imidazole derivatives as described in U.S. Pat. No. 4,260,677 (Winslow et al.). Particularly useful silver salts of this type are the silver salts of benzotriazole and substituted derivatives thereof. A silver salt of a benzotriazole is particularly preferred in aqueous-based thermographic and photo-thermographic formulations.

Useful nitrogen-containing organic silver salts and methods of preparing them are described in U.S. Pat. No. 6,977,139 (Hasberg et al.). Such silver salts (particularly the silver benzotriazoles) are rod-like in shape and have an average aspect ratio of at least 3:1 and a width index for particle diameter of 1.25 or less. Silver salt particle length is generally less than 1 μm. Also useful are the silver salt-toner co-precipitated nano-crystals comprising a silver salt of a nitrogen-containing heterocyclic compound containing an imino group, and a silver salt comprising a silver salt of a mercaptotriazole. Such co-precipitated salts are described in U.S. Pat. No. 7,008,748 (Hasberg et al.). The above patents are incorporated herein by reference.

The one or more non-photosensitive sources of reducible silver ions are preferably present in an amount of from about 5% to about 70%, and more preferably from about 10% to about 50%, based on the total dry weight of the emulsion layers. Alternatively stated, the amount of the sources of reducible silver ions is generally from about 0.002 to about 0.2 mol/m$^2$ of the dry photo-thermographic material (preferably from about 0.01 to about 0.05 mol/m$^2$).

The total amount of silver (from all silver sources) in the thermographic and photothermographic materials is generally at least 0.002 mol/m$^2$, preferably from about 0.009 to about 0.04 mol/m$^2$, and more preferably from about 0.009 to about 0.018 mol/m$^2$. In other aspects, it is desirable to use total silver [from both silver halide (when present) and reducible silver salts] at a coating weight of less than 2.0 g/m$^2$, preferably at least 1 but less than 1.8 g/m$^2$, and more preferably equal to or less than 1.6 g/m especially in photothermographic materials.

Reducing Agent

The reducing agent (or reducing agent composition comprising two or more components) for the source of reducible silver ions is a compound (preferably an organic compound) that can reduce silver(I) ion to metallic silver. The "reducing agent" is sometimes called a "developer" or "developing agent".

When a silver benzotriazole silver source is used, ascorbic acid reducing agents are preferred. An "ascorbic acid" reducing agent (also referred to as a developer or developing agent) means ascorbic acid, complexes, and derivatives thereof. An "ascorbic acid" reducing agent means ascorbic acid, complexes, and derivatives thereof. Ascorbic acid reducing agents are described in a considerable number of publications including U.S. Pat. No. 5,236,816 (Purol et al.) and references cited therein. Useful ascorbic acid developing agents include ascorbic acid and the analogues, isomers and derivatives thereof. Such compounds include, but are not limited to, D- or L-ascorbic acid, sugar-type derivatives thereof (such as sorboascorbic acid, γ-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, potassium ascorbate, isoascorbic acid (or L-erythroascorbic acid), and salts thereof (such as alkali metal, ammonium, or others known in the art), endiol type ascorbic acid, an enaminol type ascorbic acid, a thioenol type ascorbic acid, and an enamin-thiol type ascorbic acid, as described in EP 0 573 700A1 (Lingier et al.), EP 0 585 792A1 (Passarella et al.), EP 0 588 408A1 (Hieronymus et al.), U.S. Pat. Nos. 2,688,549 (James et al.), 5,089,819 (Knapp), 5,278,035 (Knapp), 5,376,510 (Parker et al.), 5,384,232 (Bishop et al.), and 5,498,511 (Yamashita et al.), Japan Kokai 7-56286 (Toyoda), and Research Disclosure, item 37152, March 1995. Mixtures of these developing agents can be used if desired.

Additionally useful are the ascorbic acid reducing agents described in copending and commonly assigned U.S. Patent Application Publication 2005/0164136 (Ramsden et al.). Also useful are the solid particle dispersions of certain ascorbic acid esters that are prepared in the presence of a particle growth modifier that are described in U.S. Patent Application Publication 2006/0051714 (Brick et al.). Both of these published applications are incorporated herein by reference.

When a silver carboxylate silver source is used in a photothermographic material, one or more hindered phenol or hindered bis-phenol reducing agents are preferred. In some instances, the reducing agent composition comprises two or more components such as a hindered phenol or hindered bis-phenol developer and one or more co-reducing agents (also known as co-developers) that can be chosen from the various classes of co-developers described below. Ternary developer mixtures involving the further addition of contrast enhancing agents are also useful. Such contrast enhancing agents can be chosen from the various classes of reducing agents described below.

"Hindered phenol reducing agents" are compounds that contain only one hydroxy group on a given phenyl ring and have at least one additional substituent located ortho to the hydroxy group.

One type of hindered phenol reducing agents are hindered phenols and hindered naphthols. This type of hindered phenol includes, for example, 2,6-di-t-butyl-4-methylphenol, 2,6-di-t-butyl-4-benzylphenol 2-benzyl-4-methyl-6-t-butylphenol, 2,4-dimethyl-6-(1'-methylcyclohexyl)phenol, and 3,5-bis(1,1-dimethylethyl)-4-hydroxy-benzenepropanoic acid 2,2-bis[[3-[3,5-bis(1,1-dimethylethyl)-4-hydroxyphenyl]-1-oxopropoxy]methyl]-1,3-propanediyl ester (IRGANOX® 1010).

Another type of hindered phenol reducing agent are hindered bis-phenols. "Hindered bis-phenols" contain more than one hydroxy group each of which is located on a different phenyl ring. This type of hindered phenol includes, for example, binaphthols (that is dihydroxybinaphthyls), biphenols (that is dihydroxybiphenyls), bis(hydroxynaphthyl)methanes, bis(hydroxyphenyl)-methanes, bis(hydroxyphenyl)ethers, bis(hydroxyphenyl)sulfones, and bis(hydroxyphenyl)thioethers, each of which may have additional substituents.

Preferred hindered bis-phenol reducing agents are bis(hydroxy-phenyl)methanes such as, bis(2-hydroxy-3-t-butyl-5-methylphenyl)methane, 1,1'-bis(2-hydroxy-3,5-dimethylphenyl)-3,5,5-trimethylhexane, bis[2-hydroxy-3-(1-methylcyclohexyl)-5-methylphenyl)methane, 1,1'-bis(2-hydroxy-3,5-dimethylphenyl)isobutane, and 2,6-bis[(2-hydroxy-3,5-dimethylphenyl)-methyl]-4-methylphenol.
Such hindered bis-phenol compounds have at least one substituent ortho to the hydroxyl group and are often referred to as "hindered ortho-bis-phenols.

Further examples of ortho-substituted bis-phenol reducing agents include bis-phenols having non-aromatic cyclic groups attached to the linking methylene group as described for example, in U.S. Pat. No. 6,699,649 (Nishijima et al.), bis-phenols having cycloaliphatic or alkylene groups attached to the linking methylene group as described for example in U.S. Patent Application Publication 2005/0221237 (Sakai et al.), and bis-phenols having secondary or tertiary substituents on the phenol rings as described for example, in U.S. Pat. No. 6,485,898 (Yoshioka et al.). Also useful reducing agents are ortho-substituted bis-phenol reducing agents, each incorporating bicyclic or tricyclic substituents ortho to the one or both hydroxyl groups on the aromatic rings. These reducing agents are described in copending and commonly assigned U.S. Ser. No. 11/351,953 (filed Feb. 10, 2006 by Lynch, Ramsden, Hansen, and Ulrich) that is incorporated herein by reference.

Additional reducing agents include the bis-phenol-phosphorous compounds described in U.S. Pat. No. 6,514,684 (Suzuki et al), the bis-phenol, aromatic carboxylic acid, hydrogen bonding compound mixture described in U.S. Pat. No. 6,787,298 (Yoshioka), and the compounds that can be one-electron oxidized to provide a one-electron oxidation product that releases one or more electrons as described in U.S. Patent Application Publication 2005/0214702 (Ohzeki). Other reducing agents that can be used include substituted hydrazines such as the sulfonyl hydrazides described in U.S. Pat. No. 5,464,738 (Lynch et al.). Still other useful reducing agents are described in U.S. Pat. Nos. 3,074,809 (Owen), 3,080,254 (Grant, Jr.), 3,094,417 (Workman), 3,887,417 (Klein et al.), 4,030,931 (Noguchi et al.), and 5,981,151 (Leenders et al.). All of these patents are incorporated herein by reference.

Mixtures of different classes of hindered phenol reducing agents can be used if desired, such as the mixture of a hindered mono-phenol and a hindered bis-phenol described in U.S. Pat. No. 6,413,712 (Yoshioka et al.) and 6,645,714 (Oya et al.).

Additional reducing agents that may also be used include amidoximes, azines, a combination of aliphatic carboxylic acid aryl hydrazides and ascorbic acid, a reductone and/or a hydrazine, piperidinohexose reductone or formyl-4-methylphenylhydrazine, hydroxamic acids, a combination of azines and sulfonamidophenols, α-cyanophenylacetic acid derivatives, reductones, indane-1,3-diones, chromans, 1,4-dihydropyridines, and 3-pyrazolidones.

Co-reducing agents chosen from the various classes of co-reducing agents described below can also be added.

Reducing agent mixtures involving the further addition of high contrast enhancing agents are also useful. Various contrast enhancing agents can also be added. Such materials are useful for preparing printing plates and duplicating films useful in graphic arts, or for nucleation of medical diagnostic films. Examples of such agents are described in U.S. Pat. Nos. 6,150,084 (Ito et al.), 6,620,582 (Hirabayashi), and 6,764,385 (Watanabe et al.). Certain contrast enhancing agents are preferably used in some photothermographic materials with specific developers and the co-developers described herein. Examples of such useful high contrast enhancing agents include, but are not limited to, hydroxylamines, alkanolamines and ammonium phthalamate compounds as described in U.S. Pat. No. 5,545,505 (Simpson), hydroxamic acid compounds as described for example, in U.S. Pat. No. 5,545,507 (Simpson et al.), N-acylhydrazine compounds as described in U.S. Pat. No. 5,558,983 (Simpson et al.), and hydrogen atom donor compounds as described in U.S. Pat. No. 5,637,449 (Harring et al.). All of the patents above are incorporated herein by reference.

The reducing agent (or mixture thereof) is generally present at from about 1 to about 25% (dry weight) of the photothermographic emulsion layer in which it is located. In multilayer constructions, if the reducing agent is added to a layer other than a photothermographic emulsion layer, slightly higher proportions, of from about 2 to 35 weight % may be more desirable. Thus, the total range for the reducing agent is from about 1 to about 35% (dry weight). Also, the reducing agent (or mixture thereof) described herein is generally present in an amount of at least 0.1 and up to and including about 0.5 mol/mol of total silver in the thermally developable material, and preferably in an amount of from about 0.1 to about 0.4 mol/mol of total silver.

Co-Developers

In addition to the reducing agents described above, the thermally developable materials also contain one or more co-developer compounds, each of which has a crown ether-alkali metal complex cation and an enolate anion of an aldehyde having at least one electron withdrawing group in the alpha (a) position (that is, attached to the carbon atom immediately adjacent to the carbon atom to which the oxygen is attached). These co-developers improve Silver Efficiency, allow a reduction in the amount of coated silver, and show little dependence in sensitometric properties with humidity, with little change in other desirable sensitometric properties such as $D_{max}$, grey scale, and photospeed.

The one or more co-developer compounds can be represented by the following Structure (I):

(I)

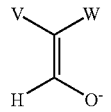

[CROWN ETHER - $M^+$]

wherein $M^+$ is an alkali metal cation, CROWN ETHER is as defined below, and at least one of V and W is an electron-withdrawing group, or V and W can be combined to form a ring containing an electron-withdrawing group.

As used herein, the electron withdrawing nature of V and W (or the group in the combined V and W) is determined by its "Hammet $\sigma_p$ (sigma) value". The Hammett $\sigma_p$ constant is defined by the Hammett Equation log K/K °=$\sigma_p$ ρ where K ° is the acid dissociation constant of the reference acid in aqueous solution at 25° C., K is the corresponding constant for the para-substituted acid, and ρ is defined as 1.0 for the dissociation of para-substituted benzoic acids. A positive Hammett sigma (σ) indicates the group is electron withdrawing. Phenyl, although being found in references to have a Hammett sigma value of −0.01 or 0 should also be acceptable.

Preferred electron withdrawing groups are those having a Hammett $\sigma_p$ value that is at least 0.20 preferably at least 0.35. Non-limiting examples of electron withdrawing groups V and W, include cyano, halogen, formyl, carboxyalkyl, carboxylic acid, nitro, perfluoroalkyl, alkylsulfonyl, and arylsulfonyl groups as well as other groups listed in *Lange's Handbook of Chemistry,* 14th Edition, McGraw-Hill, 1992, Chapter 9, pp. 2-7. Preferably both V and W are electron-withdrawing groups having a $\sigma_p$ value of at least 0.20 and more preferably at least 0.35. Most preferably both V and W have a $\sigma_p$ value of at least 0.35. Cyano and carboxyalkyl groups are particularly preferred.

The portion of the co-developer that is an enolate anion of an aldehyde having at least one electron withdrawing group in the alpha (α) position can be represented by Structure (II).

(II)

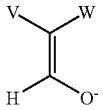

wherein V and W are as defined above. The portion of the co-developer represented by Structure (II) has been drawn and defined in the enolate form rather than in the keto-carbanion form. It would be readily understood by one skilled in the art that this is merely a formalism and the structure is actually a resonance hybrid of the two forms. Similarly, the relationship of V and W and H and $O^-$ to the double bond is drawn in one of two possible isomeric structures.

Representative, non-limiting, exemplary, compounds having Structure (II) include Compounds (CN-1) to (CN-18) shown below. Compounds CN-1, CN-2, CN-3, and CN-4 are preferred.

(CN-1)

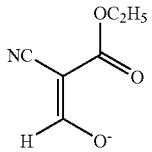

(CN-2)

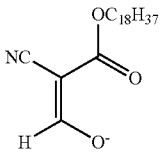

-continued (CN-3)

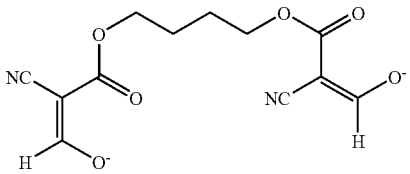

(CN-4)

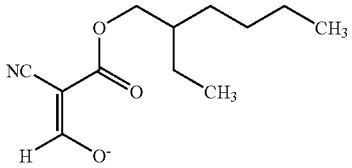

(CN-5)

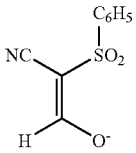

(CN-6)

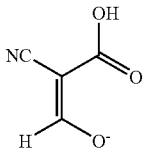

(CN-7)

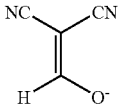

(CN-8)

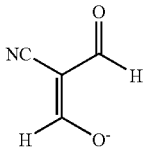

(CN-9)

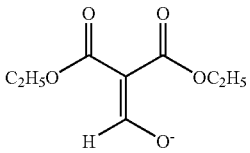

(CN-10)

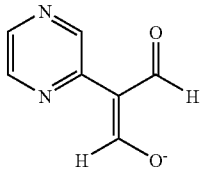

(CN-11)

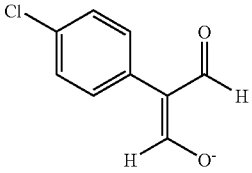

-continued (CN-12)

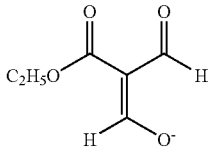

(CN-13)

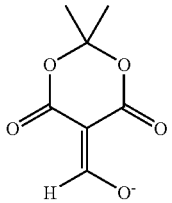

(CN-14)

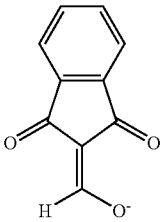

(CN-15)

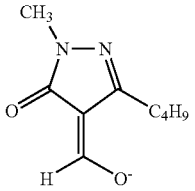

(CN-16)

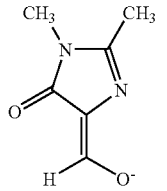

(CN-17)

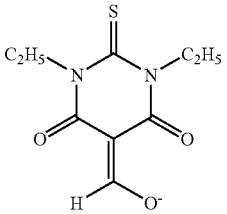

(CN-18)

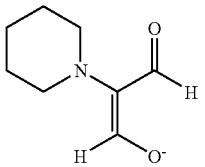

The term "crown ether" refers to heterocyclic chemical compounds that, in their simplest form, are cyclic oligomers of ethylene oxide. The essential repeating unit of any simple crown ether is ethyleneoxy, i.e., —$CH_2CH_2O$—, which repeats twice in dioxane and six times in 18-crown-6. The nine-membered ring 1,4,7-trioxonane (9-crown-3) is often called a crown and can interact with cations. Macrocycles of the (—$CH_2CH_2O$—), type in which n≧4 are generally referred to as "crown ethers" rather than by their systematic names. This is because the molecules formed when this special group of heterocycles binds to cations resemble a crown sitting on a head in structure. Crown ethers are named with the total number of atoms as a prefix, followed by the word "crown", and the number of oxygen atoms as the suffix. Thus, 18-crown-6 is made up of 6 ethylene oxide units and contains an 18 membered ring having 6 oxygen atoms. Crown ethers are notable for their ability to strongly solvate cations. The oxygen atoms are ideally situated to coordinate with a cation in the interior of the ring, whereas the exterior of the ring is hydrophobic. The result is that the complexed cation is soluble in nonpolar solvents. The size of the interior of the crown ether determines the size of the cation it can solvate. Therefore, 18-crown-6 has high affinity for potassium cation, 15-crown-5 for sodium cation and 12-crown-4 for lithium cation. (See, for example, <http://www.answers.com/crown%20ether >). Crown ethers containing units of other than ethyleneoxide, such as propyleneoxide, or substituted ethylene oxides are known and also fall within the definition of crown ethers.

Representative, non-limiting, exemplary, CROWN ETHER compounds include Compounds (CR-1) to (CR-18) shown below. Crown ether compounds (CR-1), (CR-2), and (CR-4) are preferred.

(CR-1)

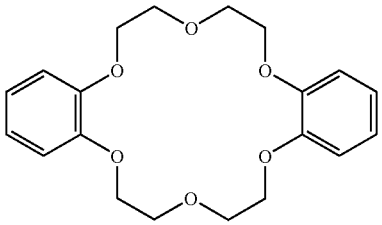

dibenzo 18-crown-6

(CR-2)

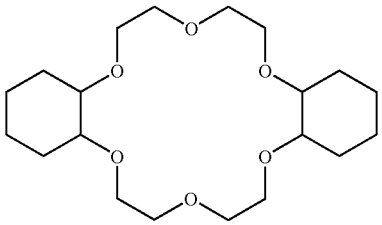

(CR-3)

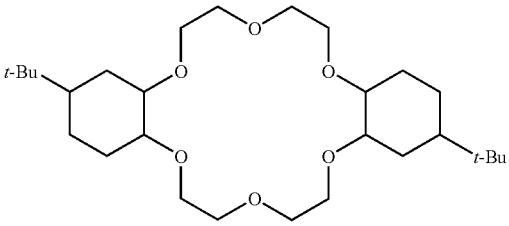

(CR-4)

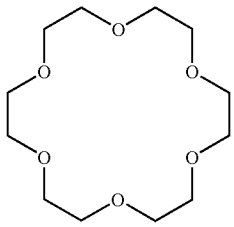

18-crown-6

-continued
(CR-5)
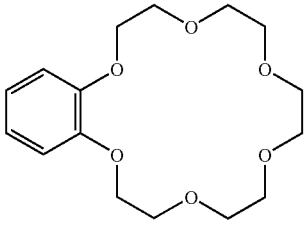
(CR-6)
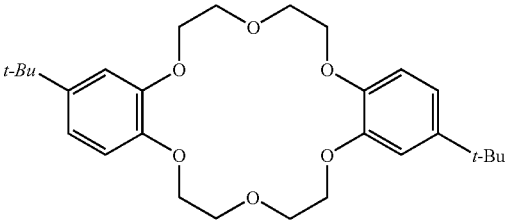
(CR-7)
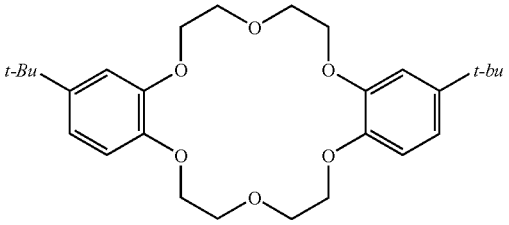
(CR-8)
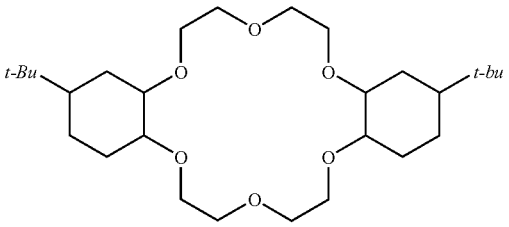
(CR-9)
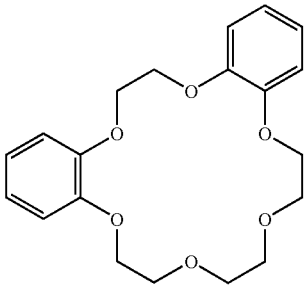
(CR-10)
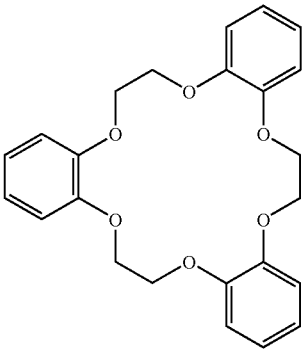
-continued
(CR-11)
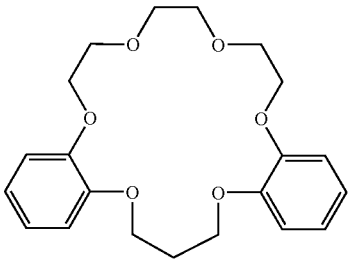
(CR-12)
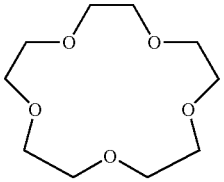
15-crown-5
(CR-13)
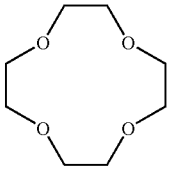
12-crown-4
(CR-14)
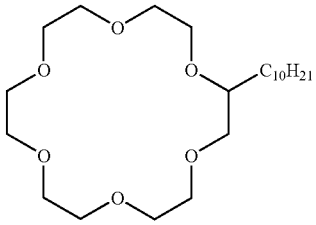
(CR-15)
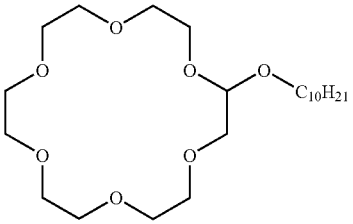
(CR-16)
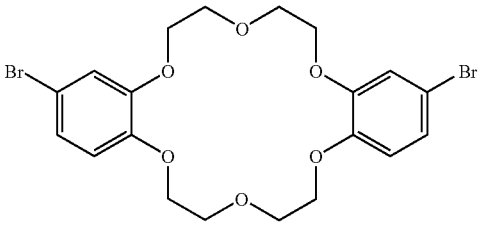

-continued (CR-17)

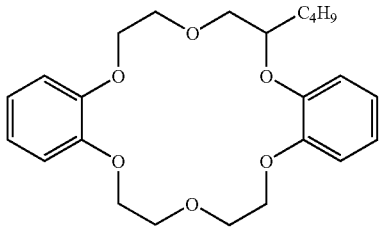

(CR-18)

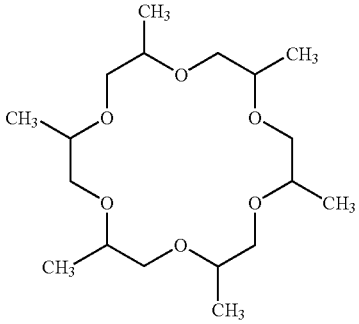

Preferably CROWN ETHER is a substituted or unsubstituted 12-crown-4 when $M^+$ is a lithium cation, a substituted or unsubstituted 15-crown-5 when $M^+$ is a sodium cation, and a substituted or unsubstituted 18-crown-6 when $M^+$ is a potassium cation, W is a cyano group or a carboxyalkyl group having from 1 to 20 carbon atoms, and V is a cyano group. Most preferably CROWN ETHER is a substituted or unsubstituted 18-crown-6, $M^+$ is a potassium cation, W is a carboxyalkyl group having 1 to 20 carbon atoms and V is a cyano group.

Representative, non-limiting, exemplary, co-developer compounds represented by Structure (I) include Compounds (CNR-1) to (CNR-11) shown below. Co-developer compounds CNR-1, CNR-2, and CNR-9 are preferred.

(CNR-1)

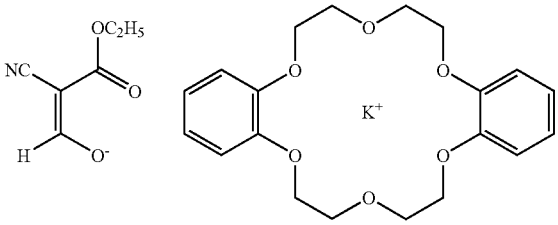

(CNR-2)

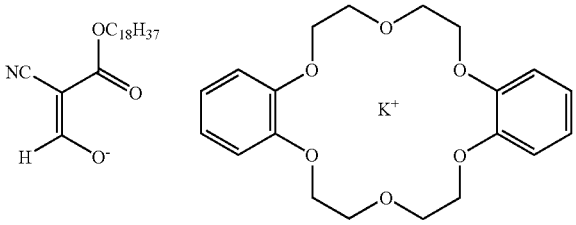

-continued (CNR-3)

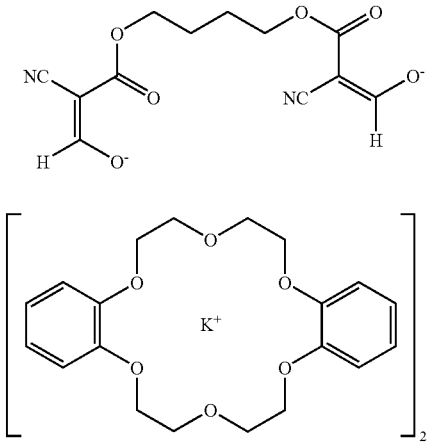

(CNR-4)

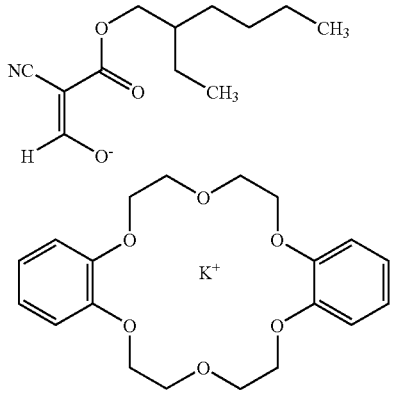

(CNR-5)

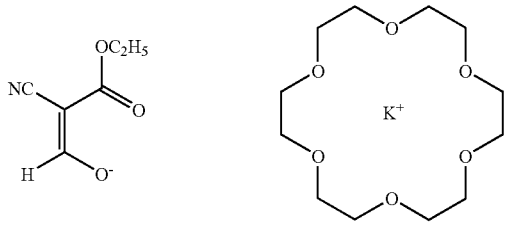

(CNR-6)

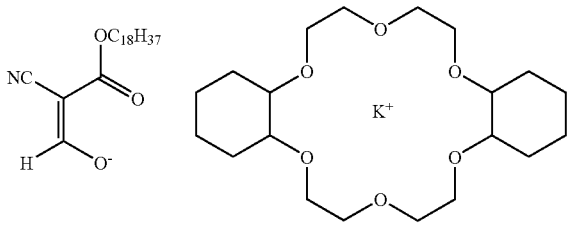

(CNR-7)

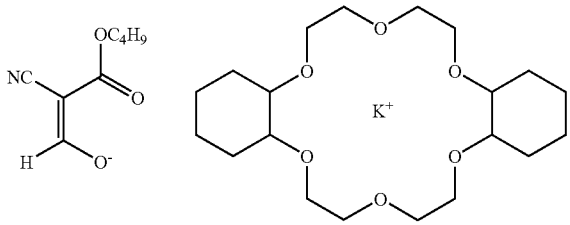

-continued (CNR_8)

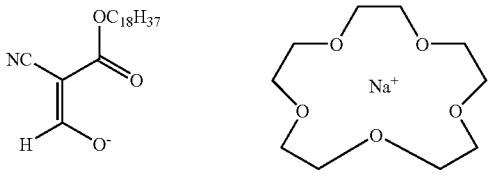

(CNR-9)

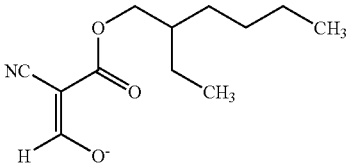

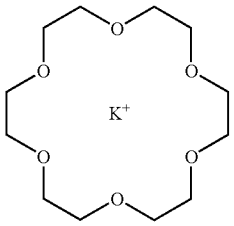

(CNR-10)

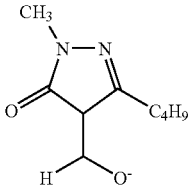

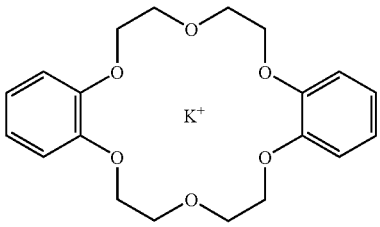

(CNR-11)

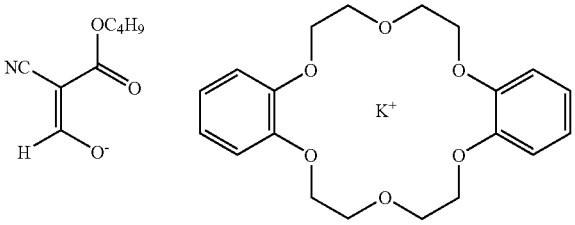

The co-developer compound that is a crown ether-alkali metal complex cation and an enolate anion of an aldehyde having at least one electron withdrawing group in the alpha (α) position, can be prepared by reacting stoichiometric amounts an alkali metal salt of a co-developer and an appropriate crown ether. The method of isolation of the product depends on whether it is a solid or oil.

An alkali metal salt of a co-developer and an appropriate crown ether are dissolved in acetone at room temperature and then precipitated with petroleum ether while cooled in a dry ice bath. Filtration and drying in air provides the product. This method is generally used when the final product is a solid.

An alkali metal salt of a co-developer and an appropriate crown ether are dissolved in acetone or methanol at room temperature. Solvent removal at reduced pressure with mild heating provides the final product. This method is generally used when the final product is an oil.

Additional classes of co-developers that can be used in combination with the inventive co-developers described herein are trityl hydrazides and formyl phenyl hydrazides as described in U.S. Pat. No. 5,496,695 (Simpson et al.). Yet another class of co-reducing agents includes substituted acrylonitrile compounds such as the compounds identified as HET-01 and HET-02 in U.S. Pat. No. 5,635,339 (Murray). All of the patents above are incorporated herein by reference.

One or more co-developer compounds can be added to any layer on the side of the support having a thermally developable thermographic or photothermographic emulsion layer as long as they are allowed to come into intimate contact with the emulsion layer during coating, drying, storage, thermal development, or post-processing storage. Thus one or more co-developer compounds can be added directly to the thermally developable thermographic or photothermographic emulsion layer or to one or more overcoat layers above the emulsion layer (for example a topcoat layer, interlayer, or barrier layer) and/or below the emulsion layer (such as to a primer layer, subbing layer, or carrier layer). Preferably one or more co-developer compounds are added directly to the emulsion layer or to an overcoat layer and allowed to diffuse into the emulsion layer.

Where the photothermographic material has one or more photothermographic layers on both sides of the support, one or more of the same or different co-developer compounds can be used on one or both sides of the support.

Generally, one or more co-developer compounds described herein are present in a total amount of at least 0.0005 g/m$^2$ in one or more layers on the imaging side of the support, of the photothermographic layer into which they are incorporated or diffused. The co-developers are preferably present in a total amount of from about 0.0005 g/m$^2$ to about 0.15 g/m$^2$, and preferably present in a total amount of from about 0.001 to about 0.05 g/m$^2$ in one or more layers on an imaging side of the support. The molar ratio of reducing agent to all co-developer compounds is generally from about 5,000:1 to about 10:1, preferably from about 1000:1 to about 100:1. Preferably the crown ether-alkali metal complex cation and enolate anion of an aldehyde having at least one electron withdrawing group in the alpha (α) position is the predominant co-developer and comprises greater than 50 mol % of the total co-developers and more preferably greater than 80%. Most preferably it is the sole co-developer.

Ternary mixtures comprising reducing agents, co-developers, and high contrast enhancing agents as described above are also useful.

Other Addenda

The thermally developable materials can also contain other additives such as shelf-life stabilizers, antifoggants, contrast enhancers (described above), toners, development accelerators, acutance dyes, post-processing stabilizers or stabilizer precursors, thermal solvents (also known as melt formers), antistatic or conductive layers, and other image-modifying agents as would be readily apparent to one skilled in the art.

Suitable stabilizers that can be used alone or in combination include thiazolium salts as described in U.S. Pat. Nos. 2,131,038 (Brooker) and 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. Nos. 2,566,263 (Trirelli) and 2,597,915 (Damshroder), and the heteroaromatic mercapto compounds or heteroaromatic disulfide compounds described in EP 0 559 228B1 (Philip et al.), all of which are incorporated by reference.

Heteroaromatic mercapto compounds are most preferred. Preferred heteroaromatic mercapto compounds include 2-mercaptobenzimidazole, 2-mercapto-5-methylbenzimidazole, 2-mercaptobenzothiazole and 2-mercapto-benzoxazole, and mixtures thereof. A heteroaromatic mercapto compound is generally present in an emulsion layer in an amount of at least 0.0001 mole (preferably from about 0.001 to about 1.0 mole) per mole of total silver in the emulsion layer.

Other useful antifoggants/stabilizers are described in U.S. Pat. No. 6,083,681 (Lynch et al.). Still other antifoggants are hydrobromic acid salts of heterocyclic compounds (such as pyridinium hydrobromide perbromide) as described in U.S. Pat. No. 5,028,523 (Skoug), benzoyl acid compounds as described in U.S. Pat. No. 4,784,939 (Pham), substituted propenenitrile compounds as described in U.S. Pat. No. 5,686,228 (Murray et al.), silyl blocked compounds as described in U.S. Pat. No. 5,358,843 (Sakizadeh et al.), the 1,3-diaryl-substituted urea compounds described copending and commonly assigned U.S. Ser. No. 11/284,928 (filed Nov. 22, 2005 by Hunt and Sakizadeh), and tribromomethylketones as described in EP 0 600 587A1 (Oliff et al.). All of these documents are incorporated herein by reference.

Additives useful as stabilizers for improving dark stability and desktop print stability are the various boron compounds described in U.S. Patent Application Publication 2006/0141404 (Philip et al.) that is incorporated herein by reference. The boron compounds are preferably added in an amount of from about 0.010 to about 0.50 g/m$^2$.

Also useful as stabilizers for improving the post-processing print stability of the imaged material to heat during storage (known as "hot-dark print stability") are the arylboronic acid compounds described in copending and commonly assigned U.S. Ser. No. 11/351,773 (filed on Feb. 10, 2006 by Chen-Ho and Sakizadeh) that is incorporated herein by reference.

The photothermographic materials preferably also include one or more polyhalogen stabilizers that can be represented by the formula Q-(Y)$_n$—C($Z_1Z_2$X) wherein, Q represents an alkyl, aryl (including heteroaryl) or heterocyclic group, Y represents a divalent linking group, n represents 0 or 1, $Z_1$ and $Z_2$ each represents a halogen atom, and X represents a hydrogen atom, a halogen atom, or an electron-withdrawing group. Particularly useful compounds of this type are polyhalogen stabilizers wherein Q represents an aryl group, Y represents (C═O) or $SO_2$, n is 1, and $Z_1$, $Z_2$, and X each represent a bromine atom. Examples of such compounds containing —$SO_2CBr_3$ groups are described in U.S. Pat. Nos. 3,874,946 (Costa et al.), 5,369,000 (Sakizadeh et al.), 5,374,514 (Kirk et al.), 5,460,938 (Kirk et al.), 5,464,747 (Sakizadeh et al.) and 5,594,143 (Kirk et al.) all of which are incorporated herein by reference. Examples of such compounds include, but are not limited to, 2-tribromomethylsulfonyl-5-methyl-1,3,4-thiadiazole, 2-tribromomethylsulfonylpyridine, 2-tribromomethylsulfonyl-quinoline, and 2-tribromomethylsulfonylbenzene. The polyhalogen stabilizers can be present in one or more layers in a total amount of from about 0.005 to about 0.01 mol/mol of total silver, and preferably from about 0.01 to about 0.05 mol/mol of total silver.

Stabilizer precursor compounds capable of releasing stabilizers upon application of heat during imaging can also be used, as described in U.S. Pat. Nos. 5,158,866 (Simpson et al.), 5,175,081 (Krepski et al.), 5,298,390 (Sakizadeh et al.), and 5,300,420 (Kenney et al.). Also useful are the blocked aliphatic thiol compounds described in U.S. Pat. No. 7,169,543 (Ramsden et al.). All of the above patents are incorporated herein by reference.

In addition, certain substituted-sulfonyl derivatives of benzo-triazoles may be used as stabilizing compounds as described in U.S. Pat. No. 6,171,767 (Kong et al.).

"Toners" or derivatives thereof that improve the image are desirable components of the thermally developable materials. These compounds, when added to the imaging layer, shift the color of the image from yellowish-orange to brown-black or blue-black. Generally, one or more toners described herein are present in an amount of from about 0.01% to about 10% (more preferably from about 0.1% to about 10%), based on the total dry weight of the layer in which the toner is included. Toners may be incorporated in the thermographic or photothermographic emulsion or in an adjacent non-imaging layer.

Compounds useful as toners are described in U.S. Pat. Nos. 3,080,254 (Grant, Jr.), 3,847,612 (Winslow), 4,123,282 (Winslow), 4,082,901 (Laridon et al.), 3,074,809 (Owen), 3,446,648 (Workman), 3,844,797 (Willems et al.), 3,951,660 (Hagemann et al.), 5,599,647 (Defieuw et al.) and GB 1,439,478 (AGFA).

Additional useful toners are substituted and unsubstituted mercaptotriazoles as described in U.S. Pat. Nos. 3,832,186 (Masuda et al.), 6,165,704 (Miyake et al.), 5,149,620 (Simpson et al.), 6,713,240 (Lynch et al.), and 6,841,343 (Lynch et al.), all of which are incorporated herein by reference.

Phthalazine and phthalazine derivatives [such as those described in U.S. Pat. No. 6,146,822 (Asanuma et al.), incorporated herein by reference], phthalazinone, and phthalazinone derivatives are particularly useful toners.

A combination of one or more hydroxyphthalic acids and one or more phthalazinone compounds can be included in the thermographic materials. Hydroxyphthalic acid compounds have a single hydroxy substituent that is in the meta position to at least one of the carboxy groups. Preferably, these compounds have a hydroxy group in the 4-position and carboxy groups in the 1- and 2-positions. The hydroxyphthalic acids can be further substituted in other positions of the benzene ring as long as the substituents do not adversely affect their intended effects in the thermographic material. Mixtures of hydroxyphthalic acids can be used if desired.

Useful phthalazinone compounds are those having sufficient solubility to completely dissolve in the formulation from which they are coated. Preferred phthalazinone compounds include 6,7-dimethoxy-1-(2H)-phthalazinone, 4-(4-pentylphenyl)-1-(2H)-phthalazinone, and 4-(4-cyclohexylphenyl)-1-(2H)-phthalazinone. Mixtures of such phthalazinone compounds can be used if desired.

This combination facilitates obtaining a stable bluish-black image after processing. In preferred embodiments, the molar ratio of hydroxyphthalic acid to phthalazinone is sufficient to provide an a* value more negative than −2 (preferably more negative than −2.5) at an optical density of 1.2 as defined by the CIELAB Color System when the material has been imaged using a thermal print-head from 300 to 400° C. for less than 50 milliseconds (50 msec) and often less than 20 msec. In preferred embodiments, the molar ratio of phthalazinone is to hydroxyphthalic acid about 1:1 to about 3:1. More preferably the ratio is from about 2:1 to about 3:1.

In addition, the imaged material provides an image with an a* value more negative than −1 at an optical density of 1.2 as defined by the CIELAB Color System when the above imaged material is then stored at 70° C. and 30% RH for 3 hours.

The thermographic materials may also include one or more additional polycarboxylic acids (other than the hydroxyphthalic acids noted above) and/or anhydrides thereof that are in thermal working relationship with the sources of reducible silver ions in the one or more thermographic layers. Such polycarboxylic acids can be substituted or unsubstituted aliphatic (such as glutaric acid and adipic acid) or aromatic compounds and can be present in an amount of at least 5 mol % ratio to silver. They can be used in anhydride or partially esterified form as long as two free carboxylic acids remain in the molecule. Useful polycarboxylic acids are described for example in U.S. Pat. No. 6,096,486 (Emmers et al.).

The addition of development accelerators that increase the rate of image development and allow further reduction in silver coating weight is also useful. Suitable development accelerators include phenols, naphthols, and hydrazinecarboxamides. Such compounds are described, for example, in Y. Yoshioka, K. Yamane, T. Ohzeki, *Development of Rapid Dry Photothermographic Materials with Water-Base Emulsion Coating Method, AgX* 2004: The International Symposium on Silver Halide Technology "At the Forefront of Silver Halide Imaging", Final Program and Proceedings of IS&T and SPSTJ, Ventura, CA, Sep. 13-15, 2004, pp. 28-31, Society for Imaging Science and Technology, Springfield, VA, U.S. Pat. No. 6,566,042 (Goto et al.), U.S. Patent Application Publications 2004/234906 (Ohzeki et al.), 2005/048422 (Nakagawa), 2005/118542 (Mori et al.), (Nakagawa), and 2006/0014111 (Goto). All of the above documents are incorporated herein by reference.

Thermal solvents (or melt formers) can also be used, including combinations of such compounds (for example, a combination of succinimide and dimethylurea). Thermal solvents are compounds which are solids at ambient temperature but which melt at the temperature used for processing. The thermal solvent acts as a solvent for various components of the heat-developable photosensitive material, it helps to accelerate thermal development and it provides the medium for diffusion of various materials including silver ions and/or complexes and reducing agents. Known thermal solvents are disclosed in U.S. Pat. Nos. 3,438,776 (Yudelson), 5,064,753 (noted above) 5,250,386 (Aono et al.), 5,368,979 (Freedman et al.), 5,716,772 (Taguchi et al.), and 6,013,420 (Windender). Thermal solvents are also described in U.S. Pat. No. 7,169,544 (Chen-Ho et al.). All of the above patents are incorporated herein by reference.

The photothermographic materials can also include one or more image stabilizing compounds that are usually incorporated in a "backside" layer. Such compounds can include phthalazinone and its derivatives, pyridazine and its derivatives, benzoxazine and benzoxazine derivatives, benzothiazine dione and its derivatives, and quinazoline dione and its derivatives, particularly as described in U.S. Pat. No. 6,599,685 (Kong). Other useful backside image stabilizers include anthracene compounds, coumarin compounds, benzophenone compounds, benzotriazole compounds, naphthalic acid imide compounds, pyrazoline compounds, or compounds described in U.S. Pat. No. 6,465,162 (Kong et al), and GB 1,565,043 (Fuji Photo). All of these patents and patent applications are incorporated herein by reference.

Phosphors are materials that emit infrared, visible, or ultraviolet radiation upon excitation and can be incorporated into the photothermographic materials. Particularly useful phosphors are sensitive to X-radiation and emit radiation primarily in the ultraviolet, near-ultraviolet, or visible regions of the spectrum (that is, from about 100 to about 700 nm). An intrinsic phosphor is a material that is naturally (that is, intrinsically) phosphorescent. An "activated" phosphor is one composed of a basic material that may or may not be an intrinsic phosphor, to which one or more dopant(s) has been intentionally added. These dopants or activators "activate" the phosphor and cause it to emit ultraviolet or visible radiation. Multiple dopants may be used and thus the phosphor would include both "activators" and "co-activators".

Any conventional or useful phosphor can be used, singly or in mixtures. For example, useful phosphors are described in numerous references relating to fluorescent intensifying screens as well as U.S. Pat. Nos. 6,440,649 (Simpson et al.) and 6,573,033 (Simpson et al.) that are directed to photothermographic materials. Some particularly useful phosphors are primarily "activated" phosphors known as phosphate phosphors and borate phosphors. Examples of these phosphors are rare earth phosphates, yttrium phosphates, strontium phosphates, or strontium fluoroborates (including cerium activated rare earth or yttrium phosphates, or europium activated strontium fluoroborates) as described in U.S. Patent Application Publication 2005/0233269 (Simpson et al.). The above patents and patent publication are incorporated herein by reference.

The one or more phosphors can be present in the photothermographic materials in an amount of at least 0.1 mole per mole, and preferably from about 0.5 to about 20 mole, per mole of total silver in the photothermographic material. As noted above, generally, the amount of total silver is at least 0.002 mol/$m^2$. While the phosphors can be incorporated into any imaging layer on one or both sides of the support, it is preferred that they be in the same layer(s) as the photosensitive silver halide(s) on one or both sides of the support Binders The photosensitive silver halide (when present), the non-photosensitive source of reducible silver ions, the reducing agent composition, and any other imaging layer additives are generally combined with one or more binders that are generally hydrophobic or hydrophilic in nature. Thus, either aqueous or organic solvent-based formulations can be used to prepare the thermally developable materials. Mixtures of either or both types of binders can also be used. It is preferred that the binder be selected from predominantly hydrophobic polymeric materials (at least 50 dry weight % of total binders).

Examples of typical hydrophobic binders include polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral, polyvinyl acetal, and polyvinyl formal) and vinyl copolymers (such as polyvinyl acetate and polyvinyl chloride) are particularly preferred. Particularly suitable hydrophobic binders are polyvinyl butyral resins that are available under the names MOWITAL® (Kuraray America, New York, N.Y.), S-LEC® (Sekisui Chemical Company, Troy, MI), BUTVAR® (Solutia, Inc., St. Louis, Mo.) and PIOLOFORM® (Wacker Chemical Company, Adrian, MI).

Hydrophilic binders or water-dispersible polymeric latex polymers can also be present in the formulations. Examples of useful hydrophilic binders include, but are not limited to, proteins and protein derivatives, gelatin and gelatin-like derivatives (hardened or unhardened), cellulosic materials such as hydroxymethyl cellulose and cellulosic esters, acrylamide/methacrylamide polymers, acrylic/methacrylic polymers polyvinyl pyrrolidones, polyvinyl alcohols, poly(vinyl lactams), polymers of sulfoalkyl acrylate or methacrylates, hydrolyzed polyvinyl acetates, polyacrylamides, polysaccharides and other synthetic or naturally occurring vehicles commonly known for use in aqueousbased photographic emulsions (see for example, Research Disclosure, item 38957, noted above). Cationic starches can also be used as a peptizer for tabular silver halide grains as described in U.S. Pat. Nos. 5,620,840 (Maskasky) and 5,667,955 (Maskasky).

One embodiment of the polymers capable of being dispersed in aqueous solvent includes hydrophobic polymers such as acrylic polymers, poly(ester), rubber (e.g., SBR resin), poly(urethane), poly(vinyl chloride), poly(vinyl acetate), poly(vinylidene chloride), poly(olefin), and the like. As the polymers above, usable are straight chain polymers, branched polymers, or crosslinked polymers. Also usable are the so-called homopolymers in which single monomer is polymerized, or copolymers in which two or more types of monomers are polymerized. In the case of a copolymer, it may be a random copolymer or a block copolymer. The molecular weight of these polymers is, in number average molecular weight, in the range from 5,000 to 1,000,000, preferably from 10,000 to 200,000. Those having too low a molecular weight exhibit insufficient mechanical strength on forming the image-forming layer, and those having too high a molecular weight are also not preferred because the resulting film forming properties are poor. Further, crosslinking polymer latexes are particularly preferred for use. Specific examples of preferred polymer latexes include:

Latex of methyl methacrylate (70)-ethyl acrylate (27)-methacrylic acid (3).

Latex of methyl methacryl ate (70)-2-ethylhexyl acrylate (20)-styrene (5)- acrylic acid (5).

Latex of styrene (50)-butadiene (47)-methacrylic acid (3).

Latex of styrene (68)-butadiene (29)-acrylic acid (3).

Latex of styrene (71)-butadiene (26)-acrylic acid (3).

Latex of styrene (70)-butadiene (27)-itaconic acid (3).

Latex of styrene (75)-butadiene (24)-acrylic acid (1).

Latex of styrene (60)-butadiene (35)-divinylbenzene (3)-methacrylic acid (2).

Latex of styrene (70)-butadiene (25)-divinylbenzene (2)-acrylic acid (3).

Latex of vinyl chloride (50)-methyl methacrylate (20)-ethyl acrylate (20)-acrylonitrile (5)-acrylic acid (5).

Latex of vinylidene chloride (85)-methyl methacrylate (5)-ethyl acrylate (5)-methacrylic acid (5).

Latex of ethylene (90)-methacrylic acid (10).

Latex of styrene (70)-2-ethylhexyl acrylate (27)-acrylic acid (3).

Latex of methyl methacrylate (63)-ethyl acrylate (35)-acrylic acid (2).

Latex of styrene (70.5)-butadiene (26.5)-acrylic acid (3).

Latex of styrene (69.5)-butadiene (27.5)-acrylic acid (3)

The numbers in parenthesis represent weight %. The polymer latexes above are commercially available. They may be used alone, or may be used by blending two or more types.

Styrene-butadiene copolymers are particularly preferable as the polymer latex for use as a binder. The weight ratio of monomer unit for styrene to that of butadiene constituting the styrene-butadiene copolymer is preferably in the range of from 40:60 to 95:5. Further, the monomer unit of styrene and that of butadiene preferably account for 60% by weight to 99% by weight with respect to the copolymer. Moreover, the polymer latex contains acrylic acid or methacrylic acid, preferably, in the range from 1% by weight to 6% by weight, and more preferably, from 2% by weight to 5% by weight, with respect to the total weight of the monomer unit of styrene and that of butadiene. The preferred range of the molecular weight is the same as that described above.

Preferred latexes include styrene (50)-butadiene (47)-methacrylic acid (3), styrene (60)-butadiene (35)-divinylbenzene-methyl methacrylate (3)-methacrylic acid (2), styrene (70.5)-butadiene (26.5)-acrylic acid (3) and commercially available LACSTAR-3307B, 7132C, and Nipol Lx416. Such latexes are described in U.S. Patent Application Publication 2005/0221237 (Sakai et al.) that is incorporated herein by reference.

Hardeners for various binders may be present if desired. Useful hardeners are well known and include diisocyanate compounds as described in EP 0 600 586 B1 (Philip, Jr. et al.), vinyl sulfone compounds as described in U.S. Pat. No. 6,143,487 (Philip, Jr. et al.) and EP 0 640 589 A1 (Gathmann et al.), aldehydes and various other hardeners as described in U.S. Pat. No. 6,190,822 (Dickerson et al.). The hydrophilic binders used in the photothermographic materials are generally partially or fully hardened using any conventional hardener. Useful hardeners are well known and are described, for example, in T. H. James, *The Theory of the Photographic Process*, Fourth Edition, Eastman Kodak Company, Rochester, N.Y., 1977, Chapter 2, pp. 77-8.

Where the proportions and activities of the thermally developable materials require a particular developing time and temperature, the binder(s) should be able to withstand those conditions. When a hydrophobic binder is used, it is preferred that the binder (or mixture thereof) does not decompose or lose its structural integrity at 120° C. for 60 seconds. When a hydrophilic binder is used, it is preferred that the binder does not decompose or lose its structural integrity at 150° C. for 60 seconds. It is more preferred that the binder not decompose or lose its structural integrity at 177° C. for 60 seconds.

The polymer binder(s) is used in an amount sufficient to carry the components dispersed therein. Preferably, a binder is used at a level of from about 10% to about 90% by weight (more preferably at a level of from about 20% to about 70% by weight) based on the total dry weight of the layer. It is particularly useful that the thermally developable materials include at least 50 weight % hydrophobic binders in both imaging and non-imaging layers on both sides of the support (and particularly the imaging side of the support).

Support Materials

The thermally developable materials comprise a polymeric support that is preferably a flexible, transparent film that has any desired thickness and is composed of one or more polymeric materials. They are required to exhibit dimensional stability during thermal development and to have suitable adhesive properties with overlying layers. Useful polymeric materials for making such supports include polyesters [such as poly(ethylene terephthalate) and poly(ethylene naphthalate)], cellulose acetate and other cellulose esters, polyvinyl acetal, polyolefins, polycarbonates, and polystyrenes. Preferred supports are composed of polymers having good heat stability, such as polyesters and polycarbonates. Support materials may also be treated or annealed to reduce shrinkage and promote dimensional stability.

It is also useful to use transparent, multilayer, polymeric supports comprising numerous alternating layers of at least two different polymeric materials as described in U.S. Pat. No. 6,630,283 (Simpson et al.). Another support comprises dichroic mirror layers as described in U.S. Pat. No. 5,795,708 (Boutet). Both of the above patents are incorporated herein by reference.

Opaque supports can also be used, such as dyed polymeric films and resin-coated papers that are stable to high temperatures.

Support materials can contain various colorants, pigments, antihalation or acutance dyes if desired. For example, the support can include one or more dyes that provide a blue color in the resulting imaged film. Support materials may be treated using conventional procedures (such as corona discharge) to improve adhesion of overlying layers, or subbing or other adhesion-promoting layers can be used.

Thermographic and Photothermographic Formulations and Constructions

An organic solvent-based coating formulation for the thermographic and photothermographic emulsion layer(s) can be prepared by mixing the various components with one or more binders in a suitable organic solvent system that usually includes one or more solvents such as toluene, 2-butanone (methyl ethyl ketone), acetone, or tetrahydrofuran, or mixtures thereof. Methyl ethyl ketone is a preferred coating solvent.

Alternatively, the desired imaging components can be formulated with a hydrophilic binder (such as gelatin, or a gelatin-derivative), or a hydrophobic water-dispersible polymer latex (such as a styrene-butadiene latex) in water or water-organic solvent mixtures to provide aqueous-based coating formulations.

The thermally developable materials can contain plasticizers and lubricants such as poly(alcohols) and diols as described in U.S. Pat. No. 2,960,404 (Milton et al.), fatty acids or esters as described in U.S. Pat. Nos. 2,588,765 (Robijns) and 3,121,060 (Duane), and silicone resins as described in GB 955,061 (DuPont). The materials can also contain inorganic and organic matting agents as described in U.S. Pat. Nos. 2,992,101 (Jelley et al.) and 2,701,245 (Lynn). Polymeric fluorinated surfactants may also be useful in one or more layers as described in U.S. Pat. No. 5,468,603 (Kub).

The thermally developable materials may also include a surface protective layer over the one or more emulsion layers. Layers to reduce emissions from the material may also be present, including the polymeric barrier layers described in U.S. Pat. Nos. 6,352,819 (Kenney et al.), 6,352,820 (Bauer et al.), 6,420,102 (Bauer et al.), 6,667,148 (Rao et al.), and 6,746,831 (Hunt), all incorporated herein by reference.

U.S. Pat. No. 6,436,616 (Geisler et al.), incorporated herein by reference, describes various means of modifying photothermographic materials to reduce what is known as the "woodgrain" effect, or uneven optical density.

To promote image sharpness, the photothermographic materials can contain one or more layers containing acutance and/or antihalation dyes. These dyes are chosen to have absorption close to the exposure wavelength and are designed to absorb scattered light. One or more antihalation compositions may be incorporated into the support, backside layers, underlayers, or overcoat layers. Additionally, one or more acutance dyes may be incorporated into one or more frontside imaging layers.

Dyes useful as antihalation and acutance dyes include squaraine dyes as described in U.S. Pat. Nos. 5,380,635 (Gomez et al.), and 6,063,560 (Suzuki et al.), and EP 1 083 459A1 (Kimura), indolenine dyes as described in EP 0 342 810A1 (Leichter), and cyanine dyes as described in U.S. Pat. No. 6,689,547 (Hunt et al.), all incorporated herein by reference.

It may also be useful to employ compositions including acutance or antihalation dyes that will decolorize or bleach with heat during processing as described in U.S. Pat. Nos. 5,135,842 (Kitchin et al.), 5,266,452 (Kitchin et al.), 5,314,795 (Helland et al.), and 6,306,566, (Sakurada et al.), and Japan Kokai 2001-142175 (Hanyu et al.) and 2001-183770 (Hanyu et al.). Useful bleaching compositions are described in Japan Kokai 11-302550 (Fujiwara), 2001-109101 (Adachi), 2001-51371 (Yabuki et al.), and 2000-029168 (Noro). All of the noted publications are incorporated herein by reference.

Other useful heat-bleachable antihalation compositions can include an infrared radiation absorbing compound such as an oxonol dye or various other compounds used in combination with a hexaarylbiimidazole (also known as a "HABI"), or mixtures thereof. HABI compounds are described in U.S. Pat. Nos. 4,196,002 (Levinson et al.), 5,652,091 (Perry et al.), and 5,672,562 (Perry et al.), all incorporated herein by reference. Examples of such heat-bleachable compositions are described for example in U.S. Pat. Nos. 6,455,210 (Irving et al.), 6,514,677 (Ramsden et al.), and 6,558,880 (Goswami et al.), all incorporated herein by reference.

Under practical conditions of use, these compositions are heated to provide bleaching at a temperature of at least 90° C. for at least 0.5 seconds (preferably, at a temperature of from about 100° C. to about 200° C. for from about 5 to about 20 seconds).

Mottle and other surface anomalies can be reduced by incorporating a fluorinated polymer as described, for example, in U.S. Pat. No. 5,532,121 (Yonkoski et al.) or by using particular drying techniques as described, for example in U.S. Pat. No. 5,621,983 (Ludemann et al.).

It is preferable for the photothermographic material to include one or more radiation absorbing substances that are generally incorporated into one or more photothermographic layer(s)to provide a total absorbance of all layers on that side of the support of at least 0.1 (preferably of at least 0.6) at the exposure wavelength of the photothermographic material. Where the imaging layers are on one side of the support only, it is also desired that the total absorbance at the exposure wavelength for all layers on the backside (non-imaging) side of the support be at least 0.2.

Thermographic and photothermographic formulations of can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. Nos. 2,761,791 (Russell), 4,001,024 (Dittman et al.), 4,569,863 (Keopke et al.), 5,340,613 (Hanzalik et al.), 5,405,740 (LaBelle), 5,415,993 (Hanzalik et al.), 5,525,376 (Leonard), 5,733,608 (Kessel et al.), 5,849,363 (Yapel et al.), 5,843,530 (Jerry et al.), and 5,861,195 (Bhave et al.), and GB 837,095 (Ilford). A typical coating gap for the emulsion layer can be from about 10 to about 750 μm, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by an X-rite Model 3611V Densitometer equipped with 301 Visual Optics, available from X-rite Corporation, (Granville, MI).

Preferably, two or more layer formulations are simultaneously applied to a support using slide coating, the first layer being coated on top of the second layer while the second layer is still wet. The first and second fluids used to coat these layers can be the same or different solvents. For example, subsequently to, or simultaneously with, application of the emulsion formulation(s) to the support, a protective overcoat formulation can be applied over the emulsion formulation. Simultaneous coating can be used to apply layers on the frontside, backside, or both sides of the support.

In other embodiments, a "carrier" layer formulation comprising a single-phase mixture of two or more polymers described above may be applied directly onto the support and thereby located underneath the emulsion layer(s) as described in U.S. Pat. No. 6,355,405 (Ludemann et al.), incorporated herein by reference. The carrier layer formulation can be simultaneously applied with application of the emulsion layer formulation(s) and any overcoat or surface protective layers.

The thermally developable materials can include one or more antistatic or conductive layers agents in any of the layers on either or both sides of the support. Conductive components include soluble salts, evaporated metal layers, or ionic polymers as described in U.S. Pat. Nos. 2,861,056 (Minsk) and 3,206,312 (Sterman et al.), insoluble inorganic salts as described in U.S. Pat. No. 3,428,451 (Trevoy), electroconductive underlayers as described in U.S. Pat. No. 5,310,640 (Markin et al.), electronically-conductive metal antimonate particles as described in U.S. Pat. No. 5,368,995 (Christian et al.), and electrically-conductive metal-containing particles dispersed in a polymeric binder as described in EP 0 678 776 A1 (Melpolder et al.). Particularly useful conductive particles are the non-acicular metal antimonate particles used in a buried backside conductive layer as described and in U.S. Pat. Nos. 6,689,546 (LaBelle et al.), 7,018,787 (Ludemann et al.), and 7,022,467 (Ludemann et al.) and in U.S. Patent Application Publications 2006/0046215 (Ludemann et al.), 2006/0046932, and 2006/0093973 (Ludemann et al.). All of the above patents and patent application publications are incorporated herein by reference.

It is particularly useful that the conductive layers be disposed on the backside of the support and especially where they are buried or underneath one or more other layers such as backside protective layer(s). Such backside conductive layers typically have a resistivity of about $10^5$ to about $10^{12}$ ohm/sq as measured using a salt bridge water electrode resistivity measurement technique. This technique is described in R. A. Elder *Resistivity Measurements on Buried Conductive Layers*, EOS/ESD Symposium Proceedings, Lake Buena Vista, FL, 1990, pp. 251-254, incorporated herein by reference. [EOS/ESD stands for Electrical Overstress/Electrostatic Discharge].

Still other conductive compositions include one or more fluoro-chemicals each of which is a reaction product of $Rf\text{-}CH_2CH_2\text{—}SO_3H$ with an amine wherein Rf comprises 4 or more fully fluorinated carbon atoms as described in U.S. Pat. No. 6,699,648 (Sakizadeh et al.) that is incorporated herein by reference.

Additional conductive compositions include one or more fluoro-chemicals described in more detail in U.S. Pat. No. 6,762,013 (Sakizadeh et al.) that is incorporated herein by reference.

The thermally developable materials may also usefully include a magnetic recording material as described in *Research Disclosure*, Item 34390, November 1992, or a transparent magnetic recording layer such as a layer containing magnetic particles on the underside of a transparent support as described in U.S. Pat. No. 4,302,523 (Audran et al.), incorporated herein by reference.

While the carrier and emulsion layers can be coated on one side of the film support, manufacturing methods can also include forming on the opposing or backside of the polymeric support, one or more additional layers, including a conductive layer, antihalation layer, or a layer containing a matting agent (such as silica), or a combination of such layers. Alternatively, one backside layer can perform all of the desired functions.

In a preferred construction, a conductive "carrier" layer formulation comprising a single-phase mixture of two or more polymers and non-acicular metal antimonate particles, may be applied directly onto the backside of the support and thereby be located underneath other backside layers. The carrier layer formulation can be simultaneously applied with application of these other backside layer formulations.

Layers to promote adhesion of one layer to another are also known, such as those described in U.S. Pat. Nos. 5,891,610 (Bauer et al.), 5,804,365 (Bauer et al.), and 4,741,992 (Przezdziecki). Adhesion can also be promoted using specific polymeric adhesive materials as described in U.S. Pat. No. 5,928,857 (Geisler et al.).

It is also contemplated that the photothermographic materials include one or more photothermographic layers on both sides of the support and/or an antihalation underlayer beneath at least one photothermographic layer on at least one side of the support. In addition, the materials can have an outermost protective layer disposed over all photothermographic layers on both sides of the support.

Imaging/Development

The thermally developable materials can be imaged in any suitable manner consistent with the type of material, using any suitable imaging source to which they are sensitive (typically some type of radiation or electronic signal for photothermographic materials and a source of thermal energy for thermographic materials). In most embodiments, the materials are sensitive to radiation in the range of from about at least 100 nm to about 1400 nm. In some embodiments, they materials are sensitive to radiation in the range of from about 300 nm to about 600 nm, more preferably from about 300 to about 450 nm, even more preferably from a wavelength of from about 360 to 420 nm. In preferred embodiments the materials are sensitized to radiation from about 600 to about 1200 nm and more preferably to infrared radiation from about 700 to about 950 nm. If necessary, sensitivity to a particular wavelength can be achieved by using appropriate spectral sensitizing dyes.

Imaging can be carried out by exposing the photothermographic materials to a suitable source of radiation to which they are sensitive, including X-radiation, ultraviolet radiation, visible light, near infrared radiation, and infrared radiation to provide a latent image. Suitable exposure means are well known and include phosphor emitted radiation (particularly X-ray induced phosphor emitted radiation), incandescent or fluorescent lamps, xenon flash lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art such as described in Research Disclosure, item 38957 (noted above). Particularly useful infrared exposure means include laser diodes emitting at from about 700 to about 950 nm, including laser diodes that are modulated to increase imaging efficiency using what is known as multi-longitudinal exposure techniques as described in U.S. Pat. No. 5,780,207 (Mohapatra et al.). Other exposure techniques are described in U.S. Pat. No. 5,493,327 (McCallum et al.).

The photothermographic materials also can be indirectly imaged using an X-radiation imaging source and one or more prompt-emitting or storage X-radiation sensitive phosphor screens adjacent to the photothermographic material. The phosphors emit suitable radiation to expose the photothermographic material. Preferred X-ray screens are those having phosphors emitting in the near ultraviolet region of the spectrum (from 300 to 400 nm), in the blue region of the spectrum (from 400 to 500 nm), and in the green region of the spectrum (from 500 to 600 nm).

In other embodiments, the photothermographic materials can be imaged directly using an X-radiation imaging source to provide a latent image.

Thermal development conditions will vary, depending on the construction used but will typically involve heating the imagewise exposed photothermographic material at a suitably elevated temperature, for example, at from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means such as contacting the material with a heated drum, plates, or rollers, or by providing a heating resistance layer on the rear surface of the material and supplying electric current to the layer so as to heat the material. A preferred heat development procedure for photothermographic materials includes heating within a temperature range of from 110 to 150° C. for 25 seconds or less, for example, at least 3 and up to 25 seconds (and preferably for 20 seconds or less) to develop the latent image into a visible image having a maximum density ($D_{max}$) of at least 3.0. Line speeds during development of greater than 61 cm/min, such as from 61 to 200 cm/min can be used.

When imaging direct thermographic materials, the image may be "written" simultaneously with development at a suitable temperature using a thermal stylus, a thermal printhead or a laser, or by heating while in contact with a heat-absorbing material. The thermographic materials may include a dye (such as an Ir-absorbing dye) to facilitate direct development by exposure to laser radiation.

Thermal development of either thermographic or photothermographic materials is carried out with the material being in a substantially water-free environment and without application of any solvent to the material.

Use as a Photomask

The thermographic and photothermographic materials can be sufficiently transmissive in the range of from about 350 to about 450 nm in non-imaged areas to allow their use in a method where there is a subsequent exposure of an ultraviolet or short wavelength visible radiation sensitive imageable medium. The thermally-developed materials absorb ultraviolet or short wavelength, visible radiation in the areas where there is a visible image and transmit ultraviolet or short wavelength visible radiation where there is no visible image. The thermally-developed materials may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed thermographic or photothermographic material provides an image in the imageable material. This method is particularly useful where the imageable medium comprises a printing plate and the thermally developable material serves as an image-setting film.

Thus, in some other embodiments wherein the thermographic or photothermographic material comprises a transparent support, the image-forming method further comprises, after steps (A) and (B) or step (A') noted above:

(C) positioning the exposed and heat-developed photothermographic material between a source of imaging radiation and an imageable material that is sensitive to the imaging radiation, and (D) exposing the imageable material to the imaging radiation through the visible image in the exposed and heat-developed photothermographic material to provide an image in the imageable material.

The following examples are provided to illustrate the practice of the present invention and the invention is not meant to be limited thereby.

Materials and Methods for the Examples:

All materials used in the following examples are readily available from standard commercial sources, such as Aldrich Chemical Co. (Milwaukee Wis.) unless otherwise specified. All percentages are by weight unless otherwise indicated. The following additional terms and materials were used.

Many of the chemical components used herein are provided as a solution. The term "active ingredient" means the amount or the percentage of the desired chemical component contained in a sample. All amounts listed herein are the amount of active ingredient added unless otherwise specified.

PARALOID® A-21 is an acrylic copolymer available from Rohm and Haas (Philadelphia, Pa.).

BZT is benzotriazole.

CAB 171-15S is a cellulose acetate butyrate resin available from Eastman Chemical Co (Kingsport, TN).

DESMODUR® N3300 is a trimer of an aliphatic hexamethylene diisocyanate available from Bayer Chemicals (Pittsburgh, Pa.).

PIOLOFORM® BL-16 is reported to be a polyvinyl butyral resin having a glass transition temperature of about 84° C. PIOLOFORM® BM-18 is reported to be a polyvinyl butyral resin having glass transition temperature of about 70° C. Both are available from Wacker Polymer Systems (Adrian, MI).

MEK is methyl ethyl ketone (or 2-butanone).

Vinyl Sulfone-1 (VS-1) is described in U.S. Pat. No. 6,143,487 and has the structure shown below.

(VS-1)

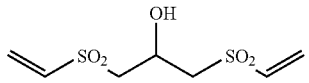

Antifoggant AF-A is 2-pyridyltribromomethylsulfone and has the structure shown below.

(AF-A)

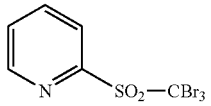

Antifoggant AF-B is ethyl-2-cyano-3-oxobutanoate. It is described in U.S. Pat. No. 5,686,228 (Murray et al.) and has the structure shown below.

(AF-B)

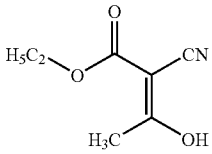

Acutance Dye AD-I has the following structure:

(AD-1)

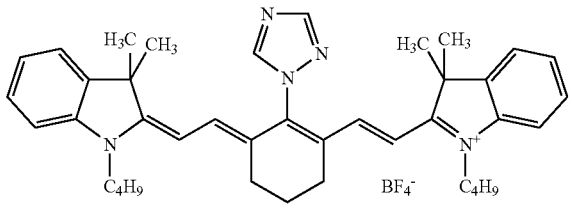

Sensitizing Dye A is described in U.S. Pat. No. 5,541,054 (Miller et al.) has the structure shown below.

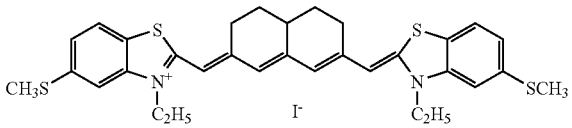

(Sensitizing Dye A)

Developer-1 (DEV-1) is bis[2-hydroxy-3-(1-methylcyclohexyl)-5-methylphenyl]methane, CAS Registry No. [77-62-3]. It was obtained from Great Lakes Chemical (West Lafayette, IN).

(DEV-1)

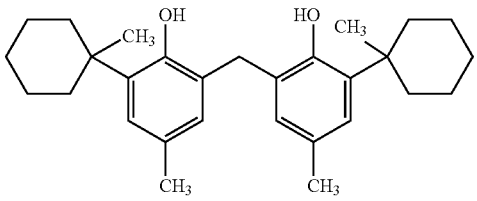

Tinting Dye TD-1 has the following structure:

(TD-1)

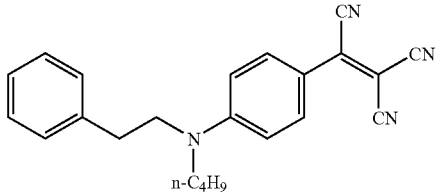

Support Dye SD-1 has the following structure:

(SD-1)

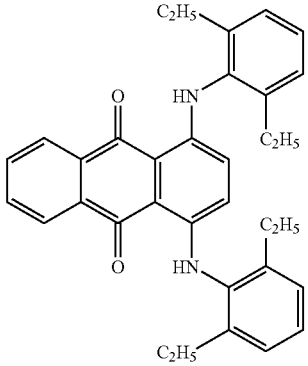

The following comparative compounds were used.

(C-CNK-1)

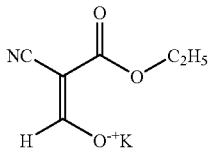

(C-CNK-2)

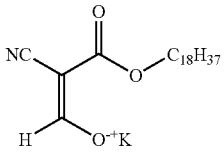

Calculation of Silver Efficiency:

Silver efficiency was calculated for each sample by dividing $D_{max}$ by the total silver coating weight. The silver coating weight of each film sample was measured by X-ray fluorescence using commonly known techniques.

Preparation of Co-developer Compounds:

Compound (CNR-1): Potassium 3-oxo-2-cyanopropanoic acid ethyl ester (1.00 mmol) and dibenzo-18-crown-6 (1.00 mmol) were dissolved in 20 ml of acetone by stirring at room temperature for 30 minutes. The mixture was cooled in a dry ice bath and petroleum ether (40-60) was added until precipitation was complete. The product was filtered and dried in air to give a yellow color powder in 94% yield. m.p.=103-104° C.

Compound (CNR-2): Potassium 3-oxo-2-cyanopropanoic acid octadecyl ester (1.00 mmol) and dibenzo-18-crown-6 (1.00 mmol) were dissolved in 10 ml of acetone by stirring at room temperature for 30 minutes. The mixture was then cooled in a dry ice bath and 10 ml of petroleum ether (40-60) was added until precipitation was complete. The product was filtered and dried in air to give a yellow colored powder in 92% yield. m.p.=91-92° C.

Compound (CNR-3): Bis(potassium 3-oxo-2-cyanopropanoic acid)-1,4-butandiol ester (1.00 mmol) and dibenzo-18-crown-6 (2.00 mmol) were dissolved in 10 ml of acetone by stirring at 50° C. for 30 minutes. To the orange colored solution was added 20 ml of petroleum ether (40-60). Stirring at room temperature was continued until precipitation was complete. The product was filtered and dried in air to give a yellow colored powder in 90% yield. m.p.=85-90° C.

Compound (CNR-4): Potassium 3-oxo-2-cyanopropanoic acid 2-ethylhexylester (10.00 mmol) and dibenzo-18-crown-6 (10.00 mmol) were dissolved in 20 ml of methanol by stirring at 50° C. for 30 minutes until a clear yellow solution was obtained. Attempted precipitation of the product by addition of petroleum ether or hexanes was unsuccessful. The solvent was removed under reduced pressure and product was obtained as viscous yellow oil in 95% yield.

Compound (CNR-5): Potassium 3-oxo-2-cyanopropanoic acid ethyl ester (20.00 mmol) and 18-crown-6 (20.00 mmol) were dissolved in 25 ml of acetone by stirring at room temperature for 30 minutes. Upon addition of 25 ml of petroleum ether (40-60) with stirring at room temperature product precipitated, was filtered off, and dried in air to give a yellow colored powder in 84% yield. m.p.=130° C.

Compound (CNR-7): Potassium-3-oxo-2-cyanopropanoic acid butyl ester (10.00 mmol) and dicyclohexano-18-crown-6 (10.00 mmol) were dissolved in 20 ml of acetone by stirring at room temperature for 30 minutes to give a clear orange solution. The product could be isolated either by removing solvent at reduced pressure at below 90° C., or by precipitation as an oil by addition of hexanes or petroleum ether while cooling in a dry-ice bath, followed by decanting of solvent. Drying of the oil in vacuo afforded compound CNR-7 as an oil in 96% yield.

Compound (CNR-11): Potassium-3-oxo-2-cyanopropanoic acid butyl ester (2.00 mmol) and dibenzo-18crown-6 (2.00 mmol) were dissolved in 10 ml of acetone by stirring at room temperature for 20 minutes to give a clear yellow solution. Addition of water to the reaction mixture produced a yellow precipitate. This was filtered off, re-crystallized from acetone-water, and dried in vacuo at 60° C. to give the pure product in 91% yield. m.p.=147° C.

EXAMPLES

The following examples demonstrate that crown ether alkali metal cations with an organic compound containing an enolate of an aldehyde having at least one electron withdrawing group in the alpha (α) position, when used in photothermographic emulsion layer formulations provide improved humidity stabilization as shown by minimal change in Silver Efficiency between dry (<25% RH) and humid environmental conditions (>78% RH).

Example 1

Preparation of Photothermographic Emulsion Formulation:

A preformed silver halide, silver carboxylate soap dispersion, was prepared in similar fashion to that described in U.S. Pat. No. 5,939,249 (noted above). The core-shell silver halide emulsion had a silver iodobromide core with 8% iodide, and a silver bromide shell doped with iridium and copper. The core made up 25% of each silver halide grain, and the shell made up the remaining 75%. The silver halide grains were cubic in shape, and had a mean grain size between 0.055 and 0.06 μm. The preformed silver halide, silver carboxylate soap dispersion was made by mixing 26.1% preformed silver halide, silver carboxylate soap, 2.1% PIOLOFORM® BM-18 polyvinyl butyral binder, and 71.8% MEK, and homogenizing three times at 8000 psi (55 MPa).

A photothermographic emulsion formulation was prepared at 67° F. (19.4° C.) containing 174 parts of the above preformed silver halide, silver carboxylate soap dispersion and 4.6 parts of MEK. To this formulation was added 1.6 parts of a 15% solution of pyridinium hydrobromide perbromide in methanol, with stirring. After 45 minutes of mixing, 2.1 parts of an 11% zinc bromide solution in methanol was added. Stirring was continued and after 30 minutes, a solution of 0.18 parts 2-mercapto-5-methylbenzimidazole, 0.009 parts of Sensitizing Dye A, 2.0 parts of 2-(4-chlorobenzoyl)benzoic acid, 10.8 parts of methanol, and 3.4 parts of MEK were added. After stirring for 75 minutes, the temperature was lowered to 50° F. (10° C.), and 37.6 parts of PIOLOFORM® BM-18, 21.2 parts of PIOLOFORM® BL-16, and 50.9 parts of MEK were added. Mixing was continued for another 15 minutes.

The emulsion formulation was completed by adding the materials shown below. Five minutes were allowed between the additions of each component.

Solution A containing:

| | |
|---|---|
| Antifoggant AF-A | 0.80 parts |
| Tetrachlorophthalic acid (TCPA) | 0.37 parts |
| 4-Methylphthalic acid (4-MPA) | 0.71 parts |
| MEK | 21 parts |
| Methanol | 0.36 parts |
| DESMODUR ® N3300 Solution | 0.66 parts in 0.33 parts MEK |
| Phthalazine (PHZ) | 1.4 parts in 6.3 parts MEK |

To 27.8 parts of the completed emulsion formulation was added 0.55 parts of DEV-1 and the amount of comparative or inventive compound or mixture shown in TABLES I and II.

Overcoat Formulation:

Overcoat formulations were prepared by mixing the following materials:

| | |
|---|---|
| MEK | 292 parts |
| PARALOID ® A-21 | 12.1 parts |
| CAB 171-15S | 132 parts |
| Vinyl Sulfone VS-1 | 0.96 parts, 80.8% active (0.78 parts net) |
| Benzotriazole (BZT) | 0.29 parts |
| Acutance Dye AD-1 | 0.50 parts |
| Antifoggant AF-B | 0.51 parts |
| DESMODUR ® N3300 Solution | 1.54 parts, in 0.76 parts MEK |
| Tinting Dye TD-1 | 0.013 parts |

Preparation of Photothermographic Materials:

Sample 1-1 contained Comparative co-developer compound C—CNK-1. This compound contains only a potassium counterion and is described in U.S. Pat. No. 5,545,515 (noted above) as a co-developer. Sample 1-2 contained a mixture of Comparative co-developer compound C—CNK-1 and crown ether compound CR-1. They were added to provide the same molar equivalent of co-developer as compound C—CNK-1. Sample 1-3 contained Inventive co-developer CNR-1 containing a crown ether-alkali metal complex cation and an enolate anion of an aldehyde having at least one electron withdrawing group in the alpha (α) position. All compounds were added in an amount necessary to provide the same molar equivalent of co-developer compound.

The photothermographic emulsion and overcoat formulations were simultaneously coated onto a 7 mil (178 μm) polyethylene terephthalate support, tinted blue with support dye SD-1. An automated dual knife coater equipped with an in-line dryer was used. Immediately after coating, samples were dried in a forced air oven at between 90 and 97° C. for between 4 and 6 minutes. The photothermographic emulsion formulation was coated to obtain a coating weight of between about 1.5 and 1.55 g of total silver/$m^2$ (between about 0.0139 and 0.0144 mol/$m^2$). The overcoat formulation was coated to obtain a dry coating weight of about 0.2 g/$ft^2$ (2.2 g/$m^2$) and an absorbance in the imaging layer between 1.5 and 1.6 at 815 nm.

A strip sample of each photothermographic material was scanned using a computerized densitometer equipped with both a visible filter and a blue filter having peak transmission at about 440 nm. TABLE I shows the values for $D_{min}$, $D_{max}$, Speed-2, and Silver Efficiency ($D_{max}$/Ag coating weight) for samples tested at 75° F. (23.9° C.) and 20% RH using the visible filter. TABLE II shows the values for $D_{min}$, $D_{max}$, Speed-2, and Silver Efficiency ($D_{max}$/Ag coating weight) for samples tested at 68° F. (20° C.) and 90% RH using the visible filter.

TABLE III shows the changes in minimum density ($\Delta D_{min}$), maximum density ($\Delta D_{max}$), Speed-2 (ΔSpeed-2), and Silver Efficiency (ΔSilver Efficiency) between Samples tested at the two relative humidities. The data demonstrate that a crown ether-alkali metal complex cation and at least one electron withdrawing group in the alpha (α) position, provide improved stabilization to changes in humidity when used in photothermographic emulsion layer formulations when compared to similar compounds lacking crown ether alkali metal cation complex. In Inventive Sample 1-3, the values for ΔSilver Efficiency and $\Delta D_{max}$ showed little change between high and low humidity. Comparative Samples 1-1 and 1-2 showed large variation in these values with changes in humidity.

TABLE I

| Sample | Compound | Amount × $10^{-6}$ (moles) | $D_{min}$ at 75° F. (23.9° C.) and 20% RH | $D_{max}$ at 75° F. (23.9° C.) and 20% RH | Speed-2 at 75° F. (23.9° C.) and 20% RH | Silver Efficiency at 75° F. (23.9° C.) and 20% RH |
|---|---|---|---|---|---|---|
| 1-1-Comparative | C-CNK-1 | 10.1 | 0.208 | 3.59 | 1.68 | 2.35 |
| 1-2-Comparative | C-CNK-1 + CR-1 | 10.1 | 0.206 | 3.61 | 1.70 | 2.42 |
| 1-3-Inventive | CNR-1 | 10.1 | 0.206 | 3.56 | 1.66 | 2.38 |

TABLE II

| Sample | Compound | Amount × $10^{-6}$ (moles) | $D_{min}$ at 68° F. (20° C.) and 90% RH | $D_{max}$ at 68° F. (20° C.) and 90% RH | Speed-2 at 68° F. (20° C.) and 90% RH | Silver Efficiency 68° F. (20° C.) and 90% RH |
|---|---|---|---|---|---|---|
| 1-1-Comparative | C-CNK-1 | 10.1 | 0.219 | 4.16 | 1.75 | 2.62 |
| 1-2-Comparative | C-CNK-1 + CR-1 | 10.1 | 0.220 | 3.91 | 1.76 | 2.70 |
| 1-3-Inventive | CNR-1 | 10.1 | 0.218 | 3.83 | 1.79 | 2.55 |

The backside of the support had been coated with an antihalation and antistatic layer having an absorbance greater than 0.3 between 805 and 815 nm, and a resistivity of less than $10^{11}$ ohms/square.

Samples of each photothermographic material were cut into strips and imaged with a laser sensitometer at 810 nm. Samples were allowed to equilibrate for 2 hours after exposure but before development. One set of samples was equilibrated at 75° F. (23.9° C.) and 20% RH (low humidity conditions). Another set was equilibrated at 68° F. (20° C.) and 90% RH (high humidity conditions). Development was carried out under these conditions.

Samples were then thermally developed to generate continuous tone wedges with image densities varying from a minimum density ($D_{min}$) to a maximum density ($D_{max}$) possible for the exposure source and development conditions. Development was carried out on a 6 inch diameter (15.2 cm) heated rotating drum. The strip contacted the drum for 210 degrees of its revolution, about 11 inches (28 cm). Samples were developed at 122.5° C. for 15 seconds at a rate of 0.733 inches/sec (112 cm/min).

TABLE III

| Sample | ΔDmin | ΔDmax | ΔSpeed-2 | Δ Silver Efficiency |
|---|---|---|---|---|
| 1-1-Comparative | 0.011 | 0.57 | 0.07 | 0.27 |
| 1-2-Comparative | 0.014 | 0.30 | 0.06 | 0.28 |
| 1-3-Inventive | 0.012 | 0.27 | 0.13 | 0.17 |

Example 2

Photothermographic emulsion and overcoat formulations were prepared as described in Example 1. Samples 2-1 and 2-2 contained Comparative co-developer compound C—CNK-1 at two different concentrations. This compound contains only a potassium counterion and is described in U.S. Pat. No. 5,545,515 (noted above) as a co-developer. Samples 2-3 and 2-4 contained Comparative co-developer compound C—CNK-2 at two different concentrations. This compound contains only a potassium counterion. Samples 2-5 and 2-6 contained a mixture of Comparative co-developer compound C—CNK-2 and crown ether compound CR-1. Samples 2-7 and 2-8 contained Inventive co-developer CNR-2 at two different concentrations. In Compound CNR-2 the potassium ion is complexed with the crown ether. All compounds were added in and amount to provide the same molar equivalent of co-developer compound.

The photothermographic emulsion formulations were coated to obtain a coating weight of between about 1.55 and 1.65 g of total silver/$m^2$ (between about 0.0144 and 0.0153 mol/$m^2$). The absorbance in the imaging layer was between 1.35 to 1.50 at 815 nm. The overcoat formulation was coated as described in Example 1.

The backside of the support had been coated with an antihalation and antistatic layer having an absorbance greater than 0.3 between 805 and 815 nm, and a resistivity of less than $10^{11}$ ohms/square.

Samples of each photothermographic material were cut into strips, equilibrated, imaged, and developed as described in Example 1. The samples were equilibrated 2 hours after exposure but before development at either 75° F. (23.9° C.) and 18% RH or at 68° F. (20° C.) and 82% RH. Development was carried out under these conditions.

A strip sample of each photothermographic material was scanned using a computerized densitometer equipped with both a visible filter and a blue filter having peak transmission at about 440 nm. TABLE IV shows the values for $D_{min}$, $D_{max}$, Speed-2, and Silver Efficiency ($D_{max}$/Ag coating weight) for samples tested at 75° F. (23.9° C.) and 18% RH using the visible filter. TABLE V shows the values for $D_{min}$, $D_{max}$, Speed-2, and Silver Efficiency ($D_{max}$/Ag coating weight) for samples tested at 68° F. (20° C.) and 90% RH using the visible filter.

TABLE VI shows the changes in minimum density ($\Delta D_{min}$), maximum density ($\Delta D_{max}$), Speed-2 (ΔSpeed-2), and Silver Efficiency (ΔSilver Efficiency) between Samples tested at the two relative humidities. The data demonstrate that compounds of a crown ether-alkali metal complex cation and an enolate anion of a β-dicarbonyl group, provide improved stabilization to changes in humidity when used in photothermographic emulsion layer formulations when compared compounds having the same anions but lacking a crown ether-alkali metal complex cation. Inventive Samples 2-7 and 2-8, showed less variation in the values for ΔSilver Efficiency and $\Delta D_{max}$ between high and low humidity while Comparative Samples 2-1 through 2-6 showed large variation in these values with changes in humidity.

TABLE IV

| Sample | Compound | Amount × $10^{-6}$ (moles) | $D_{min}$ at 75° F. (23.9° C.) and 18% RH | $D_{max}$ at 75° F. (23.9° C.) and 18% RH | Speed-2 at 75° F. (23.9° C.) and 18% RH | Silver Efficiency at 75° F. (23.9° C.) and 18% RH |
|---|---|---|---|---|---|---|
| 2-1-Comparative | C-CNK-1 | 7.6 | 0.217 | 3.64 | 1.59 | 2.29 |
| 2-2-Comparative | C-CNK-1 | 10.1 | 0.218 | 3.93 | 1.75 | 2.49 |
| 2-3-Comparative | C-CNK-2 | 7.6 | 0.206 | 3.46 | 1.64 | 2.27 |
| 2-4-Comparative | C-CNK-2 | 10.1 | 0.204 | 3.79 | 1.80 | 2.46 |
| 2-5-Comparative | C-CNK-2 + CR-1 | 7.6 | 0.218 | 3.94 | 1.66 | 2.33 |
| 2-6-Comparative | C-CNK-2 + CR-1 | 10.1 | 0.215 | 4.04 | 1.83 | 2.49 |
| 2-7-Inventive | CNR-2 | 7.6 | 0.221 | 3.87 | 1.66 | 2.34 |
| 2-8-Inventive | CNR-2 | 10.1 | 0.218 | 4.05 | 1.67 | 2.46 |

TABLE V

| Sample | Compound | Amount × $10^{-6}$ (moles) | $D_{min}$ at 68° F. (20° C.) and 82% RH | $D_{max}$ at 68° F. (20° C.) and 82% RH | Speed-2 at 68° F. (20° C.) and 90% RH | Silver Efficiency 68° F. (20° C.) and 90% RH |
|---|---|---|---|---|---|---|
| 2-1-Comparative | C-CNK-1 | 7.6 | 0.218 | 4.06 | 1.69 | 2.54 |
| 2-2-Comparative | C-CNK-1 | 10.1 | 0.217 | 4.10 | 1.85 | 2.66 |
| 2-3-Comparative* | C-CNK-2 | 7.6 | 0.205 | 4.00 | 1.77 | 2.49 |
| 2-4-Comparative* | C-CNK-2 | 10.1 | 0.204 | 4.11 | 1.90 | 2.60 |
| 2-5-Comparative | C-CNK-2 + CR-1 | 7.6 | 0.220 | 4.14 | 1.75 | 2.59 |
| 2-6-Comparative | C-CNK-2 + CR-1 | 10.1 | 0.218 | 4.19 | 1.90 | 2.68 |
| 2-7-Inventive | CNR-2 | 7.6 | 0.222 | 4.26 | 1.77 | 2.46 |
| 2-8-Inventive | CNR-2 | 10.1 | 0.219 | 4.18 | 1.78 | 2.50 |

*Samples 1-3 and 1-4 were equilibrated and developed at 70° F. (21.1° C.) and 78% ° RH

TABLE IV

| Sample | ΔDmin | Dmax | ΔSpeed-2 | Δ Silver Efficiency |
|---|---|---|---|---|
| 2-1-Comparative | 0.001 | 0.42 | 0.10 | 0.25 |
| 2-2-Comparative | −0.001 | 0.17 | 0.10 | 0.17 |
| 2-3-Comparative | −0.001 | 0.54 | 0.13 | 0.22 |
| 2-4-Comparative | 0.000 | 0.32 | 0.10 | 0.14 |
| 2-5-Comparative | 0.002 | 0.20 | 0.09 | 0.26 |
| 2-6-Comparative | 0.003 | 0.15 | 0.07 | 0.19 |
| 2-7-Inventive | 0.001 | 0.39 | 0.11 | 0.12 |
| 2-8-Inventive | 0.001 | 0.13 | 0.11 | 0.04 |

The invention has been described in detail with particular reference to certain preferred embodiments thereof, but it will be understood that variations and modifications can be effected within the spirit and scope of the invention.

The invention claimed is:

1. A thermally developable material comprising a support having on at least one side thereof, one or more thermally developable imaging layers comprising in reactive association:

a. a non-photosensitive source of reducible silver ions, b. a reducing agent for said reducible silver ions, c. a polymeric binder, and d. a co-developer compound that is a crown ether-alkali metal complex cation and an enolate anion of an aldehyde having at least one electron withdrawing group in the alpha (α) position.

2. The thermally developable material of claim 1 wherein said crown ether-alkali metal complex cation of an enolate anion of an aldehyde having at least one electron withdrawing group in the alpha (α) position, is represented by the following Structure (I):

(I)

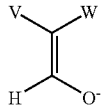

[CROWN ETHER - $M^+$]

wherein $M^+$ is an alkali metal cation, the CROWN ETHER is a substituted or unsubstituted 12-crown-4, a substituted or unsubstituted 15-crown-5, or a substituted or unsubstituted 1 8-crown-6, and at least one of V and W is an electron-withdrawing group, or V and W can be combined to form a ring containing an electron-withdrawing group.

3. The thermally developable material of claim 2 wherein $M^+$ is lithium, sodium, or potassium.

4. The thermally developable material of claim 2 wherein said CROWN ETHER is:

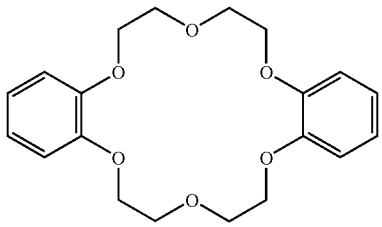

(CR-1) - dibenzo 18-crown-6

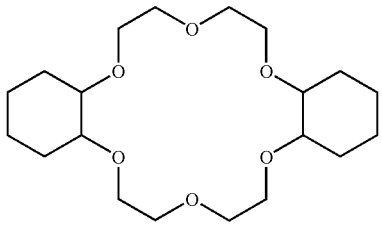

(CR-2)

-continued

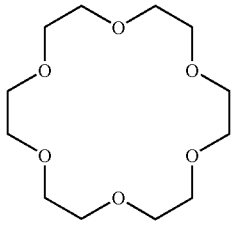

(CR-4) - 18-crown-6.

5. The thermally developable material of claim 2, wherein CROWN ETHER is a substituted or unsubstituted 12-crown-4 when $M^+$ is a lithium cation, a substituted or unsubstituted 15-crown-5 when $M^+$ is a sodium cation, and a substituted or unsubstituted 1 8-crown-6 when $M^+$ is a potassium cation, W is a cyano group or a carboxyalkyl group having from 1 to 20 carbon atoms, and V is a cyano group.

6. The thermally developable material of claim 2 that is a photothermographic material and further comprises a photosensitive silver halide.

7. The thermally developable material of claim 1 further comprising a high contrast enhancing agent.

8. The thermally developable material of claim 7 wherein said high contrast enhancing agent is an hydroxylamine, alkanolamine, ammonium phthalamate, hydroxamic acid, N-acylhydrazine, or hydrogen atom donor compound.

9. The thermally developable material of claim 1 wherein the total amount of silver is equal to or less than 1.6 $g/m^2$.

10. The thermally developable material of claim 1 further comprising a protective overcoat layer disposed over said photothermographic layer.

11. The thermally developable material of claim 1 wherein said co-developer compound is present in one or more layers in a total amount of from about 0.0005 to about 0.15 $g/m^2$.

12. The thermally developable material of claim 1 that is a photothermographic material and further comprises a photosensitive silver halide.

13. The thermally developable material of claim 1 wherein the molar ratio of said reducing agent to said co-developer compound is from about 1000:1 to about 100:1.

14. A method of forming a visible image comprising:

A) imagewise exposing the material of claim 1 that is a photothermographic material to electromagnetic radiation to form a latent image, and B) simultaneously or sequentially, heating said exposed photothermographic material to develop said latent image into a visible image.

15. The method of claim 14 wherein said development is carried out for up to 25 seconds.

16. The method of claim 14 wherein said imagewise exposing is carried out using laser imaging at from about 700 to about 950 nm.

17. A method of forming a visible image comprising thermal imaging of the material of claim 1 that is a thermographic material.

18. A photothermographic material comprising a support having on at least one side thereof, one or more thermally developable imaging layers comprising in reactive association:

a. a photosensitive silver halide, b. a non-photosensitive source of reducible silver ions, c. a reducing agent for said reducible silver ions, d. a polymeric binder, and e. a co-developer compound that is a crown ether-alkali metal complex cation and an enolate anion of an aldehyde having at least one electron withdrawing group in the alpha ($\alpha$) position, having a Hammett $\sigma_p$ value that is at least 0.35.

19. The photothermographic material of claim 18 wherein said co-developer compound is present in an amount of from about 0.001 g/m$^2$ to about 0.05 g/m$^2$.

20. A black-and-white, organic solvent based photothermographic material comprising a support and having on at least one side thereof a photothermographic layer and comprising, in reactive association:

a. a photosensitive silver bromide or iodobromide, b. a non-photosensitive source of reducible silver ions, comprising at least silver behenate, c. one or more reducing agents for said reducible silver ions, d. a polyvinyl butyral or polyvinyl acetal binder, and e. one or more co-developer compounds represented by Structure (1)

(I)

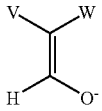

[CROWN ETHER - M$^+$]

wherein CROWN ETHER is a substituted or unsubstituted 18-crown-6, M$^+$ is a potassium cation, W is a carboxyalkyl group having 1 to 20 carbon atoms and V is a cyano group, the total amount of silver is present in an amount equal to or less than 1.6 g/m$^2$, and said co-developer compound is present in an amount of at least 0.0005 g/m$^2$.

21. The photothermographic material of claim 20 wherein said one or more co-developer compounds comprises one or more of compounds (CNR-1 to (CNR-11) or mixtures thereof (CNR-1)

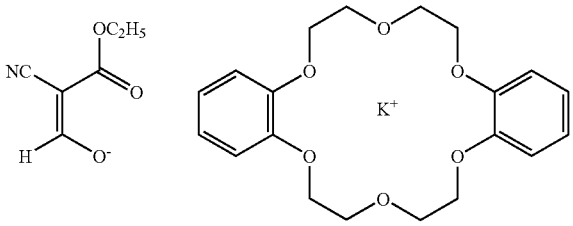

(CNR-2)

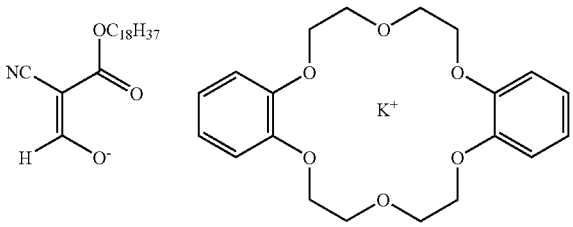

-continued (CNR-3)

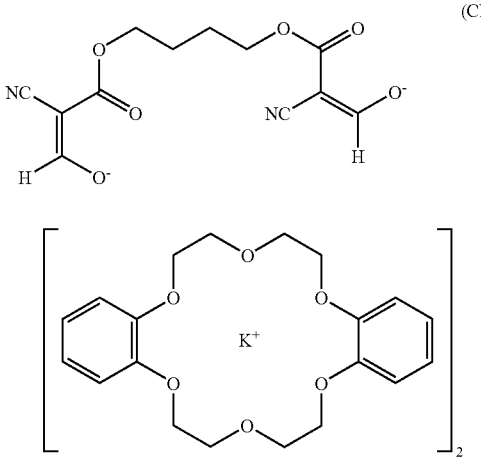

(CNR-4)

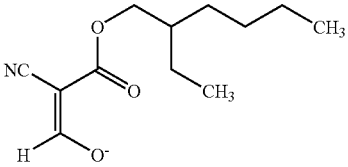

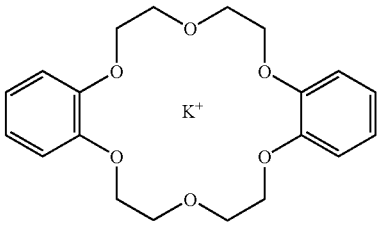

(CNR-5)

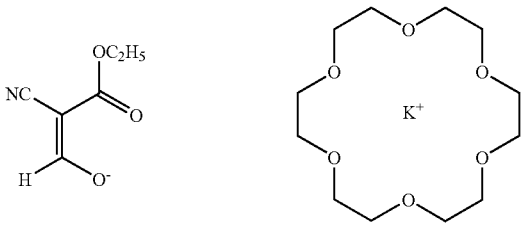

(CNR-6)

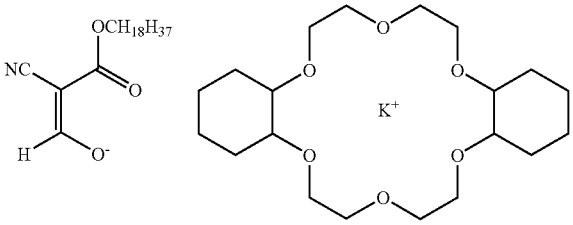

(CNR-7)

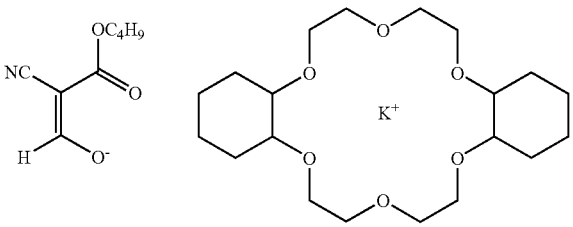

-continued
(CNR-8)
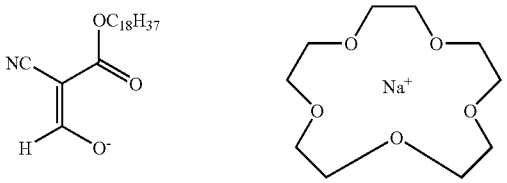
(CNR-9)
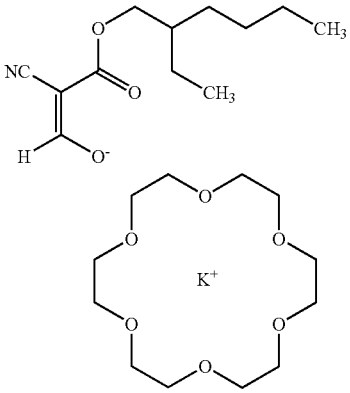
-continued
(CNR-10)
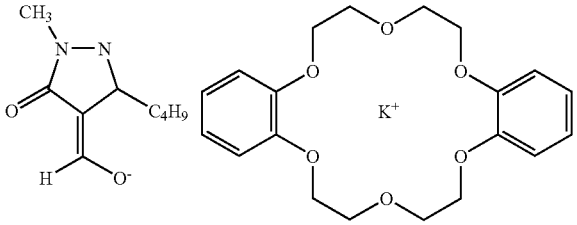
(CNR-11)
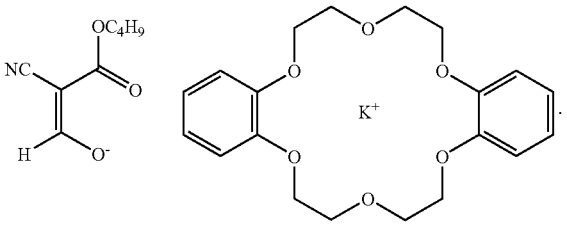
* * * * *